US005887227A

United States Patent [19]

Kawai et al.

[11] Patent Number: 5,887,227

[45] Date of Patent: Mar. 23, 1999

[54] DEVELOPING DEVICE

[75] Inventors: Tachio Kawai, Odawara; Jun Miyamoto, Susono; Kanji Yokomori, Odawara; Koji Miura, Mishima; Kazuhiko Kanno; Takeshi Arimitsu, both of Numazu; Hideki Sato, Hirosaki, all of Japan

[73] Assignee: Canon Kabushiki Kaisha, Tokyo, Japan

[21] Appl. No.: 856,864

[22] Filed: May 15, 1997

[30] Foreign Application Priority Data

May 17, 1996 [JP] Japan ..... 8-122882

[51] Int. Cl.[6] ..... G03G 15/00; G03G 15/08

[52] U.S. Cl. ..... 399/98; 399/93; 399/119

[58] Field of Search ..... 399/93, 98, 111, 399/119, 120, 262

[56] References Cited

U.S. PATENT DOCUMENTS

| | | | |
|---|---|---|---|
| 4,377,334 | 3/1983 | Nishikawa | 355/3 |
| 4,939,548 | 7/1990 | Yamada et al. | 355/245 |
| 5,283,619 | 2/1994 | Nomura et al. | 355/261 |
| 5,528,349 | 6/1996 | Satake | 399/262 |
| 5,682,585 | 10/1997 | Yamuguchi et al. | 399/274 |

FOREIGN PATENT DOCUMENTS

| | | |
|---|---|---|
| 60-230676 | 11/1985 | Japan . |
| 04-298772 | 10/1992 | Japan . |
| 4-361280 | 12/1992 | Japan . |
| 06-208301 | 7/1994 | Japan . |

OTHER PUBLICATIONS

Patent Abstracts of Japan, vol. 10, No. 97 (P–446), 15 Apr. 1986.

Patent Abstracts of Japan, vol. 18, No. 567 (P–1820), 28 Oct. 1994.

Patent Abstracts of Japan, vol. 17, No. 109 (P–1497) 5 Mar. 1993.

*Primary Examiner*—Joan H. Pendegrass

*Attorney, Agent, or Firm*—Fitzpatrick, Cella, Harper & Scinto

[57] ABSTRACT

A developing device which is capable of being detachably mounted to a rotary unit of an image forming apparatus and which includes a developer carrying member for forming a development region together with an image carrying member and rotating as carrying a developer, a developer containing section for containing the developer to be supplied to the developer carrying member, and a pressure relief portion provided in a surface substantially perpendicular to the rotational axis of the rotary unit, of the developer containing section.

14 Claims, 22 Drawing Sheets

DEVELOPING DEVICE

BACKGROUND OF THE INVENTION

1. Field of the Invention

The present invention relates to a developing device for developing an electrostatic image on an image carrying member, used in an image forming apparatus such as an electrophotographic apparatus or an electrostatic recording apparatus.

2. Related Background Art

Conventionally proposed as a configuration of apparatus for forming a multi-color image by the electrophotographic method is a method for locating a plurality of developing devices containing respective developing agents or developers of different colors (each of which will be referred to as "toner") on a rotating/selecting mechanism with respect to a photosensitive drum being an electrophotographic, photosensitive member, opposing either one developing device containing the toner of a predetermined color to the photosensitive drum to form a developed image, transferring this developed image onto a recording medium, and further carrying out these developing and transferring operations for each of the colors, thereby obtaining the multi-color image. Some apparatuses employ the cartridge structure for the foregoing developing devices arranged to be detachably mounted on the image forming apparatus, thereby lightening the maintenance work of user.

Such developing devices are normally constructed in such a way that a toner supply roll obtained by attaching a sponge roll to a metal core is pressed against a developing roller in order to supply the toner in a toner container to the developing roller being a toner carrying member.

In such toner supply structure, air pressure inside the toner container increases with rotation of the developing roller and toner supply roll, and the air therein leaks from a portion of weak seal strength to the outside.

In order to prevent the toner inside the toner container from leaking out with the air at this time, a pressure relief portion for relief of the air within the toner container to the outside is provided and a filter is attached to the pressure escape portion, thereby allowing only the air to escape to the outside.

With use of the conventional developing devices the filter, however, tends to cause clogging due to the toner or the like and the filter might be damaged when pressure is applied on the filter because of movement of toner or the like in the toner container during physical distribution or when something hits the toner container from the outside.

SUMMARY OF THE INVENTION

An object of the present invention is to provide a developing device that can let the air escape without clogging.

Another object of the present invention is to provide a developing device arranged to prevent the filter from being damaged.

Still another object of the present invention is to provide a developing device capable of being detachably mounted to a rotary unit of an image forming apparatus, said developing device comprising:

- a developer carrying member for forming a development region together with an image carrying member, said developer carrying member rotating as carrying a developer;
- a developer containing section for containing the developer to be supplied to said developer carrying member; and
- a pressure relief portion provided in a surface substantially perpendicular to the rotational axis of said rotary unit, of the developer containing section.

Further objects of the present invention will become apparent in the description which follows.

BRIEF DESCRIPTION THE DRAWINGS

DETAILED DESCRIPTION OF THE PREFERRED EMBODIMENTS

The embodiments of the present invention will be described with reference to the drawings.

[First Embodiment]

Figure 1:
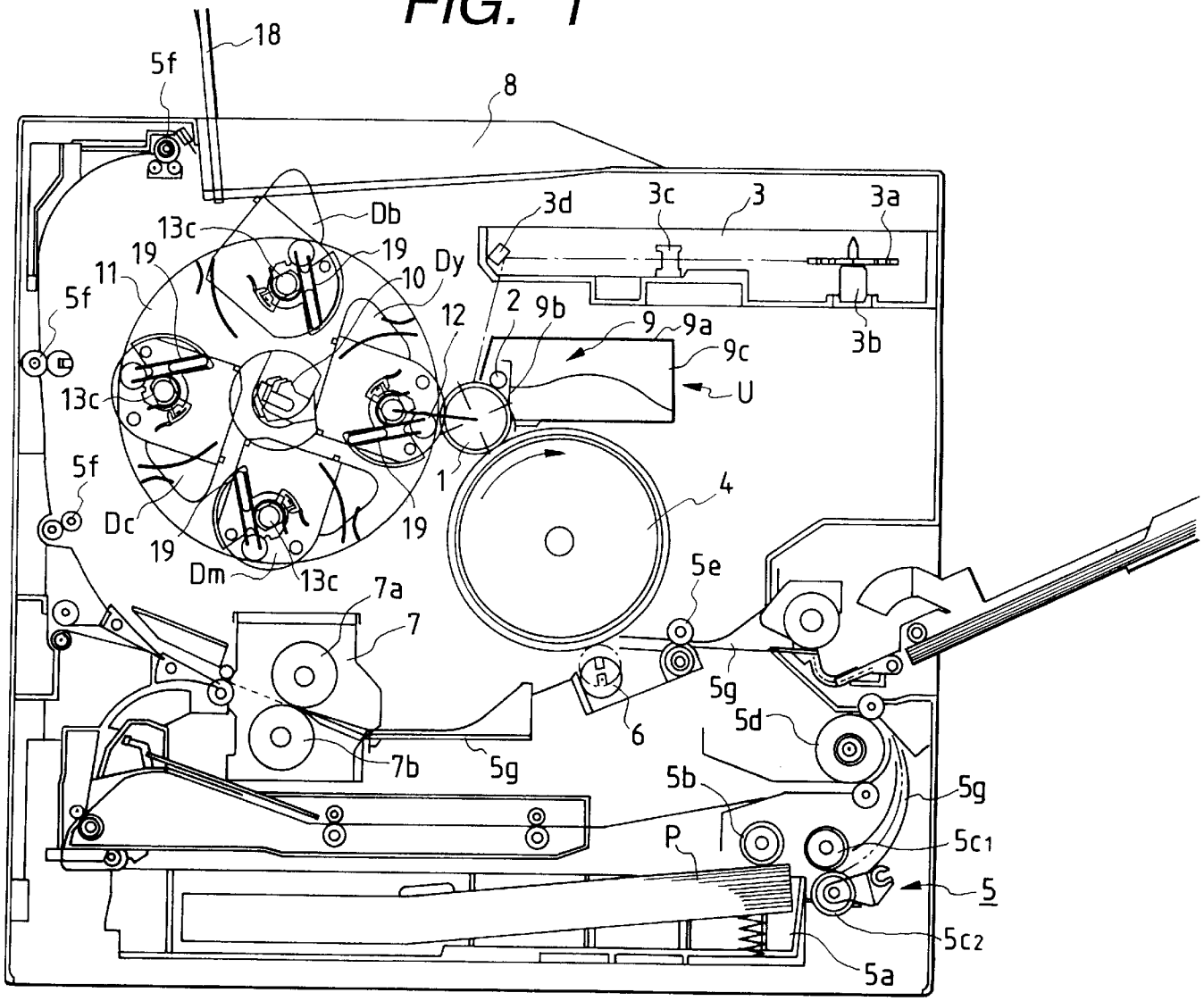
FIG. 1 is a schematic, explanatory drawing to show the overall structure of an electrophotographic image forming apparatus according to the first embodiment.
Figure 2:
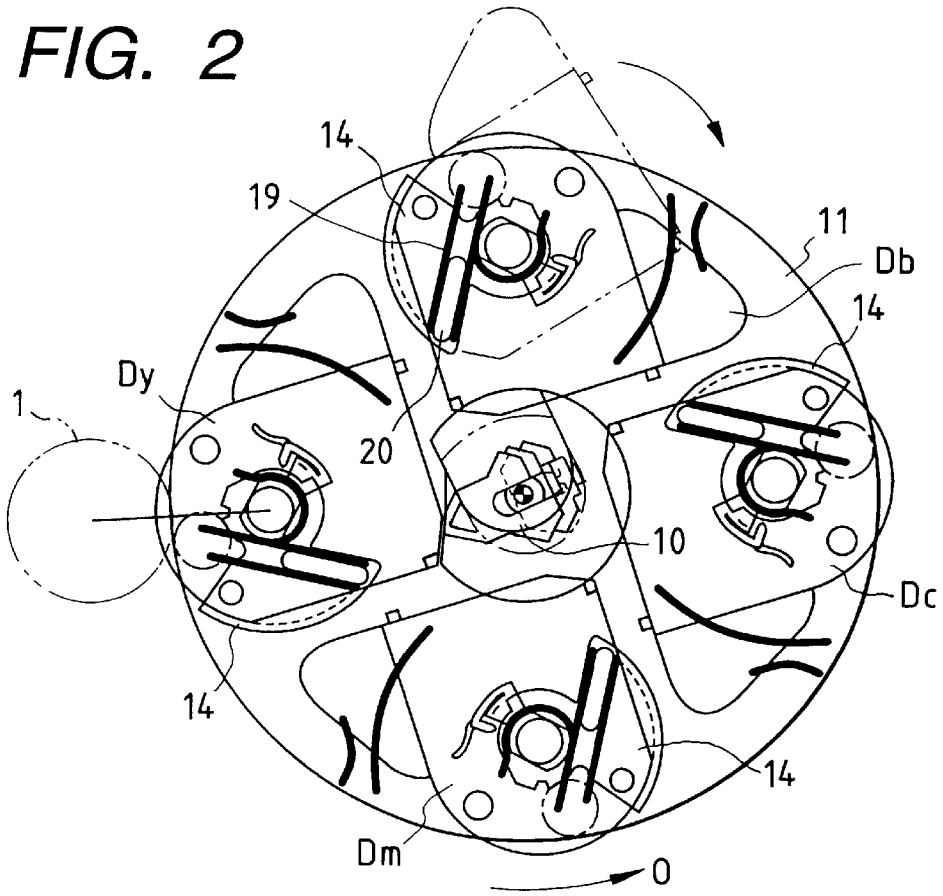
FIG. 2 is an explanatory drawing to show the structure of the developing devices and rotary unit.
Figure 3:
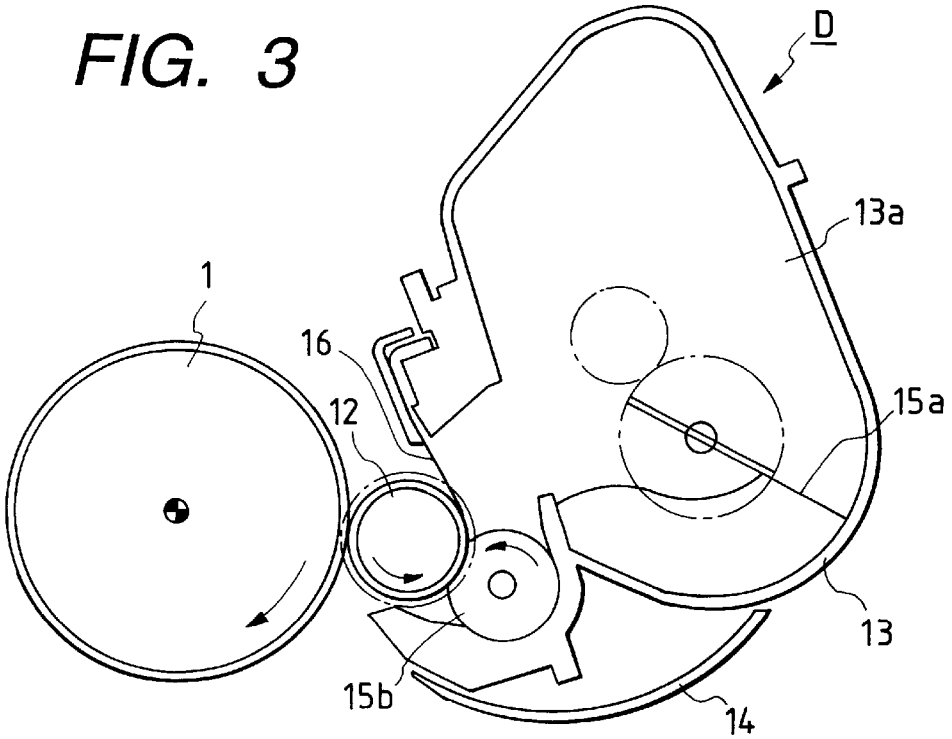
FIG. 3 is an explanatory drawing to show the structure of the developing device.
Figure 4:
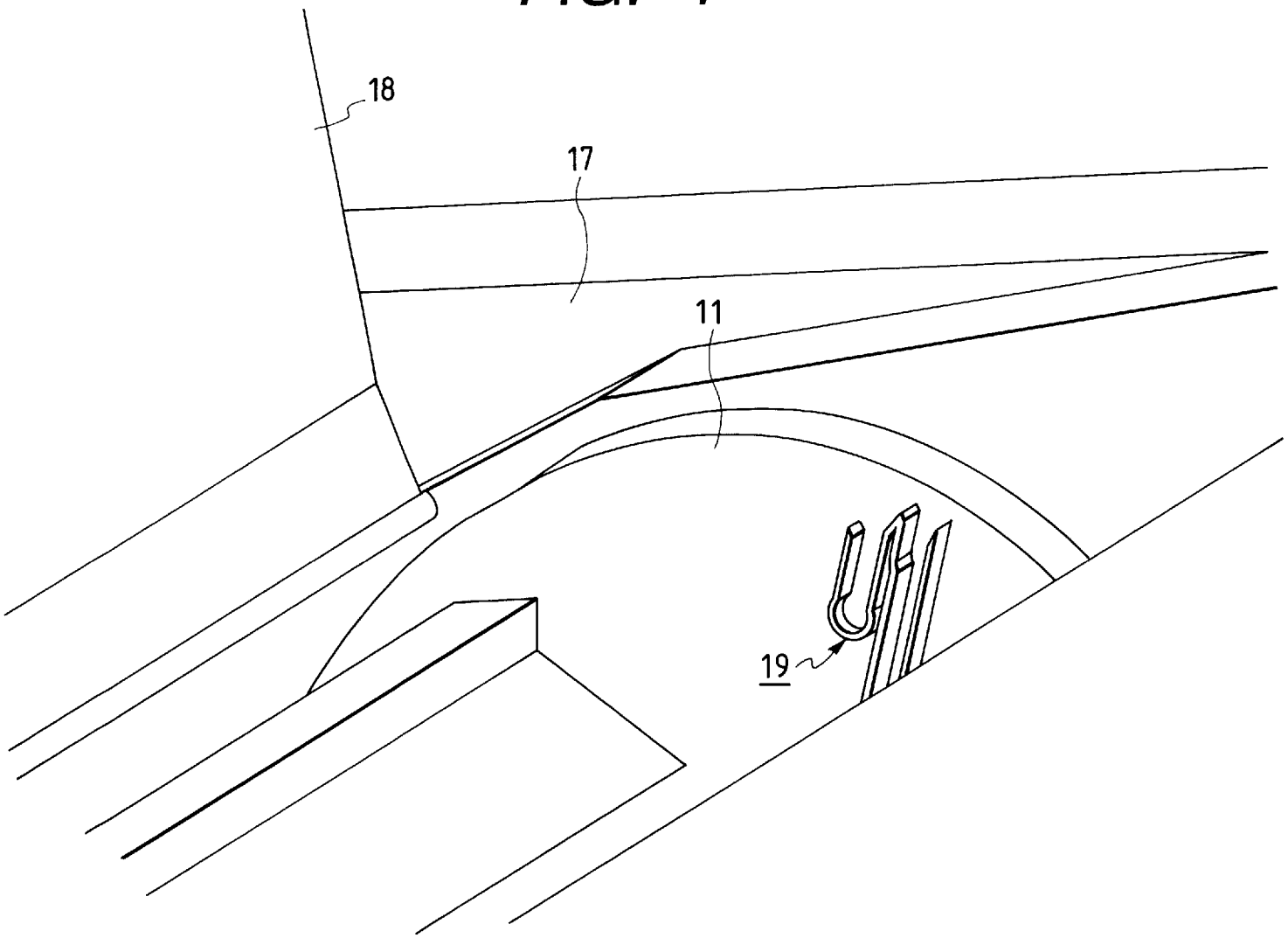
FIG. 4 is an explanatory drawing to show the structure of mount means of the developing device provided in the main body of image forming apparatus.
Figure 5:
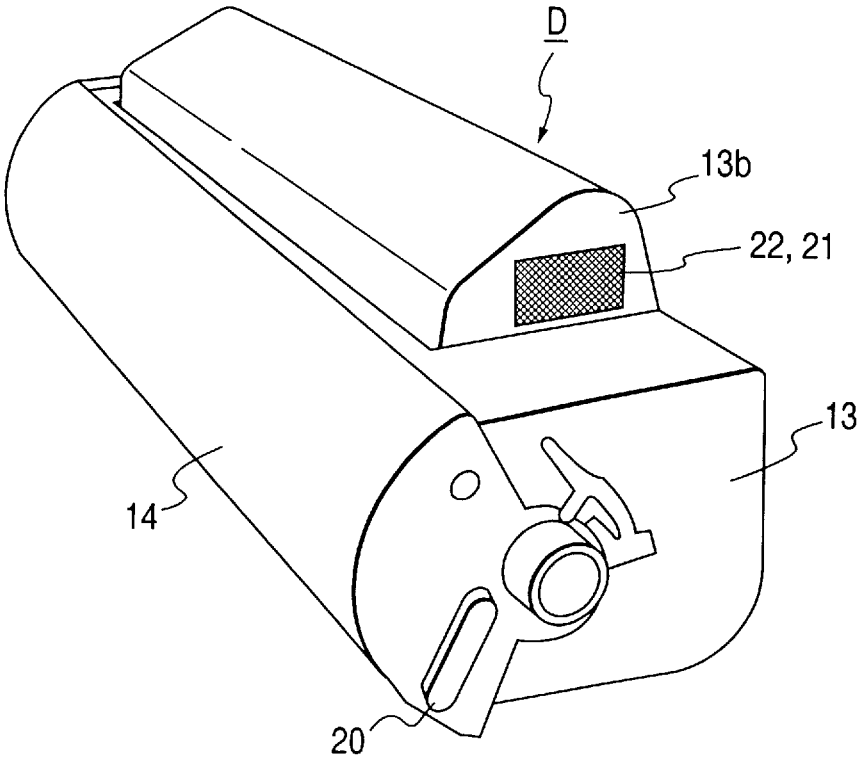
FIG. 5 is a perspective, explanatory drawing of the developing device.

The first embodiment of the present invention will be described referring to FIG. 1 to FIG. 5. FIG. 1 is a schematic, explanatory drawing to show the overall structure of the electrophotographic image forming apparatus according to the first embodiment, FIG. 2 is an explanatory drawing to show the structure of the developing devices and rotary unit, FIG. 3 is an explanatory drawing to illustrate the structure of the developing device, FIG. 4 is an explanatory drawing to illustrate the structure of mount means of the developing device provided in the main body of the image forming apparatus, and FIG. 5 is a perspective, explanatory drawing of the developing device.

Here is first described the overall structure of the electrophotographic image forming apparatus and then the structure of the developing devices.

[Image Forming Apparatus]

First described is the schematic structure of the image forming apparatus according to the present embodiment. As shown in FIG. 1, the illustrated apparatus is a laser beam printer which is a form of the image forming apparatus for forming a color image by the electrophotographic method. In the laser beam printer, a charging means 2 uniformly charges a surface of photosensitive drum 1 being an electrophotographic photosensitive member rotating at a constant rate, a laser beam is guided from exposure means 3 to the drum to form a latent image thereon, and the latent image is developed by either one of four rotatable developing devices Dy, Dm, Dc, Db. Then the images successively formed on the photosensitive drum 1 are multiplex-transferred in order onto an intermediate transfer member 4 to form a color image. This color image is transferred by transfer means 6 onto a recording medium P conveyed from a sheet supply section by conveying means 5, then the recording medium P is conveyed to fixing means 7 to fix the color image, and the recording medium is discharged onto a discharge section 8 on the top surface of apparatus.

The structure of each of the above-stated sections will be described in detail.

First, the photosensitive drum 1 is incorporated with a frame of cleaning means 9 for removing the residual toner after transfer of the toner image onto the recording medium P, thus composing a drum unit U. This drum unit U is detachably supported in the main body of image forming apparatus, so that it can be replaced with another, depending upon the lifetime of photosensitive drum 1.

The photosensitive drum 1 is constructed by coating the outside of an aluminum cylinder having the diameter of about 50 mm with an organic photoconductor layer and is rotatably supported by the frame 9*a* of cleaning means 9 also serving as a holder of the photosensitive drum 1. On the periphery of this photosensitive drum 1 there are provided a cleaning blade 9*b* for scraping the residual toner from the photosensitive drum 1, and the charging means 2.

Driving force of a driving motor not illustrated is transmitted to the photosensitive drum 1, whereby the photosensitive drum 1 rotates counterclockwise in FIG. 1 in accordance with the image forming operation.

The charging means 2 associated with the present embodiment is one employing the so-called contact charging method, which uniformly charges the surface of photosensitive drum 1 by applying voltage to an electrically conductive roller rotating in contact with the surface of photosensitive drum 1.

In the exposure means 3 for carrying out exposure onto the thus charged photosensitive drum 1, when an image signal is supplied to a laser diode not illustrated, this laser diode radiates image light corresponding to the image signal toward a polygon mirror 3*a*. This polygon mirror 3*a* is rotated at high speed by a scanner motor 3*b* and the image light reflected by the mirror 3*a* is guided via imaging lens 3*c* and reflecting mirror 3*d* to effect selective exposure on the surface of photosensitive drum 1 rotating at constant speed, thereby forming an electrostatic latent image.

The latent image is developed for every color by the developing devices. The structure of the developing devices will be described later.

A toner image developed by each developing device is transferred onto the intermediate transfer member 4, and the toner image visualized on the drum by each developing device upon formation of color image is multiplex-transferred onto the intermediate transfer member 4 four times (the images of four colors by the four developing devices). For this, the intermediate transfer member 4 rotates clockwise in FIG. 1 in synchronism with the speed of the periphery of the photosensitive drum 1, and the intermediate transfer member 4 subjected to the multiplex transfer conveys the recording medium P as pinching it together with the transfer roller 6 of transferring means to which voltage is applied, thereby simultaneously multiplex-transferring the toner images of the respective colors on the intermediate transfer member 4 onto the recording medium P.

The intermediate transfer member 4 associated with the present embodiment has such structure that the periphery of an aluminum cylinder having the diameter of about 150 mm is covered by an elastic layer of intermediate-resistance sponge, intermediate-resistance rubber, or the like. The intermediate transfer member 4 is rotatably supported and is driven to rotate by a gear integrally fixed thereto.

The cleaning means 9 eliminates the toner remaining on the surface of photosensitive drum 1 after transfer of toner image onto the intermediate transfer member 4. The cleaning means 9 scrapes the residual toner from the drum surface by the cleaning blade 9*b* in contact with the drum surface and stores the residual toner in a waste toner container 9*c*. An amount of waste toner that can be stored in this container 9*c* is determined to be a capacity that will never fill the container 9*c* fully before the lifetime of photosensitive drum 1. The waste toner in the container 9*c* is replaced and disposed together with the drum unit U when the drum unit U is replaced with another at the end of the lifetime of photosensitive drum 1.

The transfer means for transferring the toner image multiplex-transferred on the intermediate transfer member 4 onto the recording medium P is a transfer roller 6 in the present embodiment and this roller 6 is constructed by wrapping an intermediate-resistance, foamed, elastic member around a metal shaft and is arranged so as to be movable vertically in FIG. 1.

During formation of the four-color toner image on the intermediate transfer member 4, i.e., during plural rotations of the intermediate transfer member 4, the transfer roller 6 retracts from the intermediate transfer member 4 to be located underneath thereof, as shown by the solid line of FIG. 1, so as not to disturb the image.

After the toner images have been multiplex-transferred onto the intermediate transfer member 4 to form the color image, the transfer roller 6 is moved to the up position, as shown by the chain line of FIG. 1, by an unillustrated cam at the timing of transferring the color image onto the recording medium P. This causes the transfer roller 6 to be pressed against the intermediate transfer member 4 under predetermined pressure with the recording medium P in between. At the same time, bias voltage is applied to the transfer roller 6, whereby the toner image on the intermediate transfer member 4 is transferred onto the recording medium P.

As shown in FIG. 1, the conveying means 5 for conveying the recording medium P is composed of cassette 5*a* containing a plurality of recording media P, pickup roller 5*b*, feed roller 5cl, retard roller 5*c*2 for preventing multiple feed, conveying roller pair 5*d*, registration roller pair 5*e*, discharge roller pair 5*f*, and conveying guide 5*g*.

Upon formation of an image, the pickup roller 5*b* is driven to rotate according to the image forming operation, thereby separating and feeding the recording media P in the cassette 5*a* one by one and guiding each medium by the conveying guide 5*g* via the conveying roller pair 5*d* to the registration roller pair 5*e*. During the image forming operation the registration rollers 5*e* undertake non-rotating operation for keeping the recording medium P still in standby and rotating operation for conveying the recording medium P toward the intermediate transfer member 4 in a predetermined sequence and perform positioning of the recording medium P with respect to the image at a transfer step as a next step, followed by transfer of the color image by the transfer means as described above.

The recording medium P on which the color image has been transferred is conveyed to the fixing means 7, where the toner image is fixed. This fixing means 7 is composed of a fixing roller 7*a* for applying heat onto the recording medium P and a pressing roller 7*b* for pressing the recording medium P against the fixing roller 7*a*. Both rollers 7*a*, 7*b* are hollowed rollers with a heater inside and are driven to rotate. They convey the recording medium P as applying the heat and pressure thereto, thereby fixing the toner image on the recording medium P.

Then the toner-fixed recording medium P is discharged onto the discharge section 8 by the discharge roller pair 5*f* forming the conveying means.

[Developing Devices]

Next described is the structure of the developing devices for visualizing the latent image formed on the photosensitive drum 1.

For forming the color image, this image forming apparatus has four developing devices D (Dy, Dm, Dc, Db) enabling development of each color of yellow, magenta, cyan, and black. These developing devices D are detachably mounted in a rotary unit 11 arranged to rotate about a rotary shaft 10, as shown in FIG. 1 and FIG. 2. During formation of image each developing device D rotationally moves about the shaft 10 as being held in the rotary unit 11, a predetermined developing device D stops at the position to face the photosensitive drum 1, a developing roller described hereinafter is positioned so as to be opposed to the photosensitive drum 1 with a fine gap (approximately 300 $\mu$m or so), and thereafter the toner is supplied corresponding to the electrostatic latent image on the photosensitive drum 1, thereby visualizing the latent image.

During formation of a color image the rotary unit 11 rotates every rotation of the intermediate transfer member 4 to perform development steps in the order of yellow developing device Dy, magenta developing device Dm, cyan developing device Dc, and black developing device Db.

FIG. 3 shows a state in which one developing device D (for example, the yellow developing device Dy) stops as positioned at the position to face the photosensitive drum 1. This developing device D is composed of a developing roller 12 as a toner carrying member for supplying the toner to the photosensitive drum 1, a toner container 13 having a toner containing section 13*a* for containing the toner to be supplied to the developing roller 12 and for supporting the developing roller 12, and a shutter 14 capable of opening and closing an opening for exposing the developing roller 12 provided in the container 13. In the toner containing section 13*a* a toner feed member 15*a* is arranged to rotate and a toner supply roll 15*b* in which a sponge roll is attached to a metal core is also arranged to rotate as being pressed against the developing roller 12 in order to supply the toner to the developing roller 12.

The developing roller 12 is a rotatable aluminum sleeve and a developing blade 16 is urged against the peripheral surface of this developing roller 12. Because of this, when the developing roller 12 rotates counterclockwise in FIG. 3, the peripheral surface is coated with a thin layer of toner and a charge is given to the toner (due to triboelectrification or frictional charging).

By applying the development bias to the developing roller 12 opposed to the photosensitive drum 1 with the latent image formed thereon, a toner image according to the latent image can be developed on the photosensitive drum 1.

The above structure and development mechanism are common to the yellow developing device Dy, magenta developing device Dm, cyan developing device Dc, and black developing device Db. The developing roller 12 of each developing device D becomes connected to a high-voltage power supply for development of each color and to a drive source provided in the main body of image forming apparatus when each developing device D is rotated to move to the development position. Then the development bias voltage is selectively applied in order for each color development and the developing roller 12 etc. start rotating.

Next described is the structure for mounting the developing device D to the image forming apparatus. As shown in FIG. 4, an insertion aperture 17 having the width longer than the longitudinal length of the developing device is provided at a predetermined position of the main body of image forming apparatus and a cover 18 is attached to this insertion aperture 17 so as to be capable of being opened and closed. The cover 18 usually closes the insertion aperture 17.

The main body of apparatus is provided with a developing device replacement switch (not illustrated). For replacing the developing device D, the switch is depressed, which causes the rotary unit 11 to rotate before the developing device of a color desired to be mounted may move to the position of the insertion aperture 17.

When the cover 18 is opened, guide 19 forming the mount means of the developing device D is provided in the main body of image forming apparatus. On the other hand, the shutter 14 of developing device D is provided with guide portion 20, as shown in FIG. 5. The developing device D is inserted into the main body of image forming apparatus by inserting the guide portion along the guide 19. The guide 19 and guide portion 20 ate provided on either side in the longitudinal direction of developing device D (i.e., in the direction of the rotary shaft of developing roller 12) (though FIG. 4 and FIG. 5 illustrate only one side).

After the developing device D is set in the main body of apparatus as described above, the developing device D is rotated, so as to automatically open the shutter 14 to expose the developing roller 12 and to position the developing roller 12 opposite the photosensitive drum 1, whereby it is mounted in a state ready for development.

In the developing device D, a pressure relief portion 21, formed as a through hole for letting the air inside the toner containing section 13*a* escape to the outside, is provided in a side surface in the longitudinal direction of the toner container 13, i.e., in a wall surface 13*b* perpendicular to the direction of axis 10 of the rotary unit 11. A filter 22 is attached to this pressure relief portion 21, thereby preventing the toner in the toner containing section 13*a* from leaking through the pressure relief section 21 to the outside. This filter 22 is made of a porous material and in a sheet form and is attached to the toner container 13 by thermal bonding, adhesion, or an adhesive tape or the like so as to close the pressure relief portion 21.

As described above, when the developing device D is mounted in the rotary unit 11 rotating in the direction of arrow O of FIG. 2 about the axis 10 and when the developing device D rotates to move as being held by the rotary unit 11 upon formation of image, the powder pressure of toner due to the centrifugal force is exerted on a surface parallel with the rotation center axis 10 of rotary unit 11 (a surface parallel with the longitudinal direction) among the wall surfaces of toner container 13, but the powder pressure of toner is unlikely to be exerted on the wall surface 13*b* perpendicular to the rotation center axis 10 of the rotary unit 11 as in the present embodiment. Therefore, the pressure relief portion 21 is provided at the aforementioned position in the wall surface 13*b* and the filter 22 is attached to the pressure relief portion 21, whereby the filter 22 can be prevented from being broken by the powder pressure of toner.

[Second Embodiment]

Figure 6:
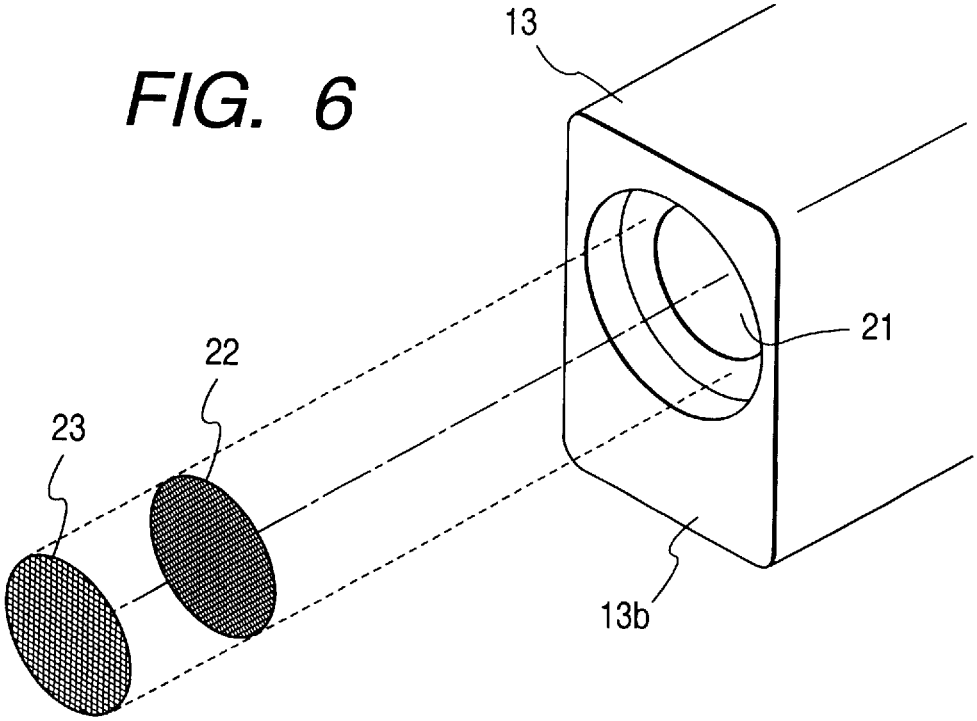
FIG. 6 is a perspective, explanatory drawing of a filter attaching portion according to the second embodiment.
Figure 7:
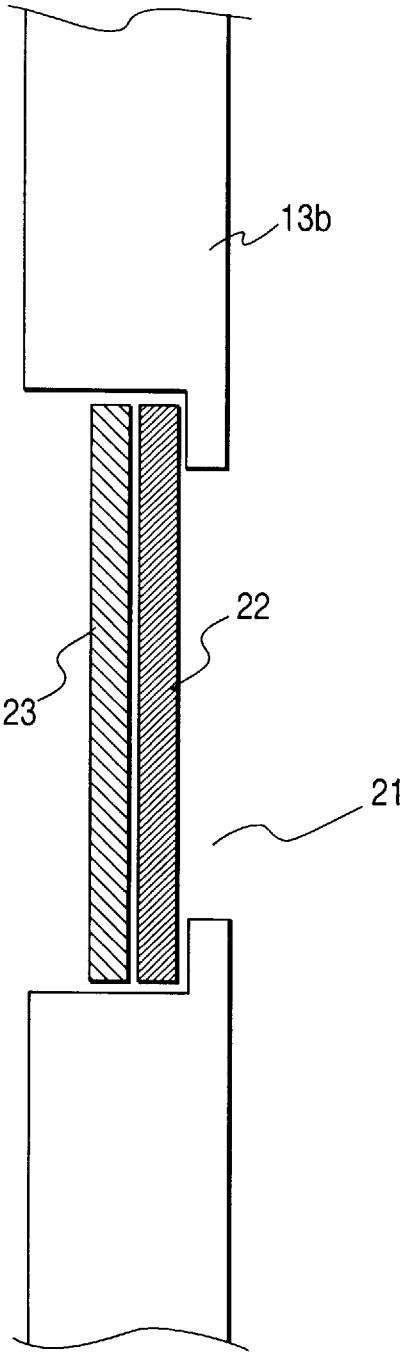
FIG. 7 is a cross-sectional, explanatory drawing of the filter attaching portion.

Another embodiment of the installation structure of the pressure relief portion and filter in the developing devices will be described referring to FIG. 6 and FIG. 7. FIG. 6 is a perspective, explanatory drawing of the filter attaching portion according to the second embodiment and FIG. 7 is a cross-sectional, explanatory drawing of the filter attaching portion. The elements functioning in the same manner as in the previous embodiment will be denoted by the same reference characters and redundant description will be omitted.

The first embodiment described above showed the structure in which the pressure relief portion 21 and filter 22 were provided in the wall surface 13*b* perpendicular to the rotation center axis 10 of the rotary unit 11 in the developing device D, thereby preventing breakage of filter 22 or the like due to the powder pressure of toner, but it is conceivable that the filter 22 might be damaged, for example, when the user touches the outer surface of filter 22 carelessly upon exchange of developing device D.

Thus, the second embodiment is constructed to dispose an outside protection member 23 on the outer surface side of the filter 22 attached to the side surface of toner container 13. This protection member 23 is comprised of a member having at least one hole in the portion covering the filter 22 (which is a plastic member with many holes in a grid pattern in the present embodiment). The filter 22 and protection member 23 are attached to the toner container 13 by thermal bonding, adhesion, screwing, or the like so as to close the pressure relief portion 21.

The above structure can prevent the internal pressure in the toner container 13 from breaking the filter 22 and can also prevent external force from being exerted on the filter 22 and from breaking the filter.

If the filter 22 and protection member 23 are integrally formed as a unit, assembly of filter 22 etc. will become easier. The shape of the pressure relief portion 21, the shape of the holes formed in the protection member 23, and the material thereof do not have to be limited to those in the embodiment described above.

[Third Embodiment]

Figure 9:
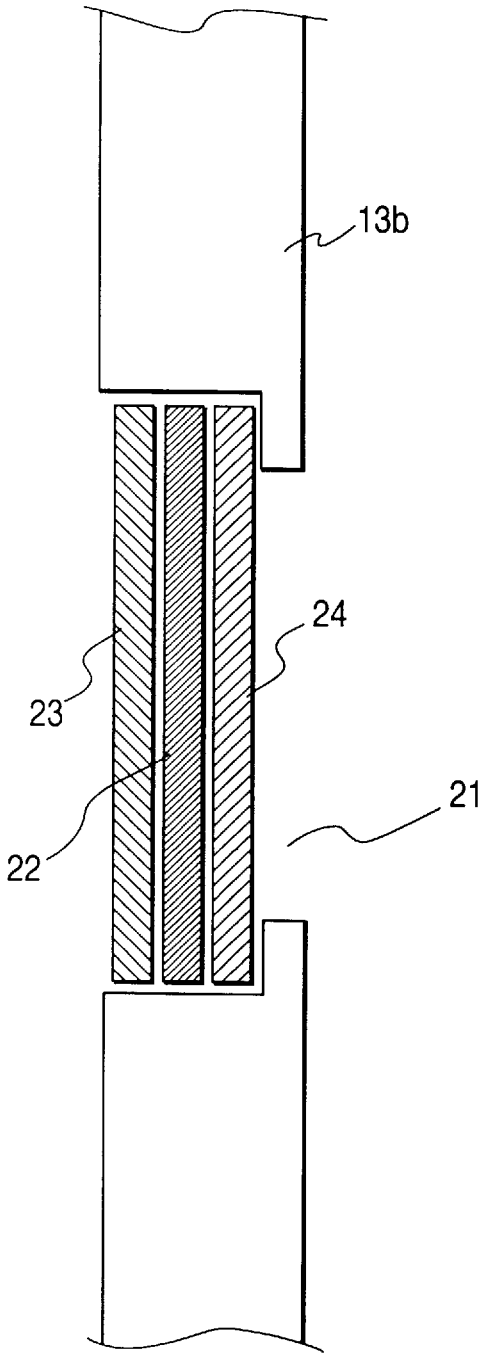
FIG. 9 is a cross-sectional, explanatory drawing of the filter attaching portion.
Figure 8:
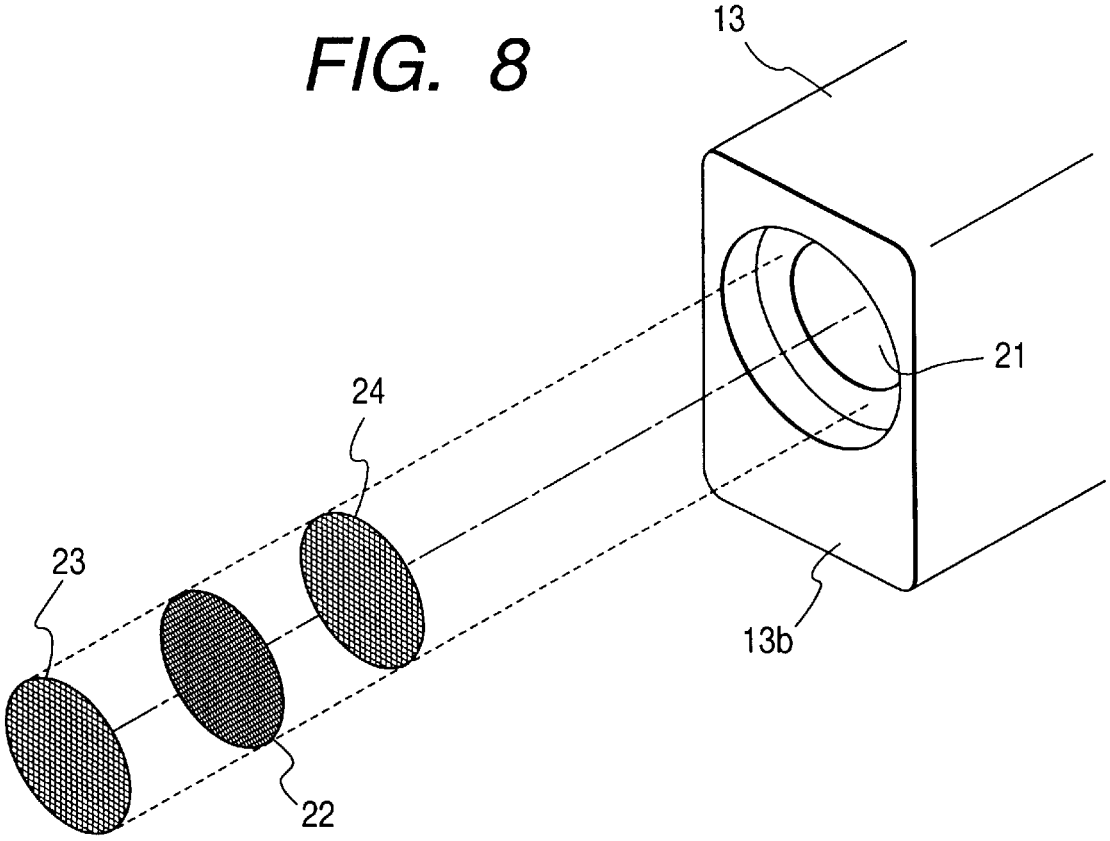
FIG. 8 is a perspective, explanatory drawing of the filter attaching portion according to the third embodiment.

Another embodiment of the installation structure of the pressure relief portion and filter in the developing device will be described referring to FIG. 8 and FIG. 9. FIG. 8 is a perspective, explanatory drawing of the filter attaching portion according to the third embodiment and FIG. 9 is a cross-sectional, explanatory drawing of the filter attaching portion. Also in this case, the elements functioning in the same manner as in the foregoing embodiments will be denoted by the same reference characters and redundant description will be omitted.

The foregoing embodiments described the prevention of breakage of filter 22 upon application of the internal force or the external force of toner container 13 onto the filter 22, whereas the present embodiment is arranged to dispose an outside protection member 23 outside the filter 22 and to dispose an inside protection member 24 inside the filter 22. The inside protection member 24 is a member similar to the outside protection member 23 and the installation structure of the filter 22, the outside protection member 23, and the inner protection member 24 is similar to that in the previous embodiment.

The above structure can protect the filter 22 not only by the outside protection member 23 in the case of the external force being applied to the filter 22, but also by the inside protection member 24 in the case of the internal force, such as the powder pressure of toner, being applied thereto, which can further enhance the effect to prevent breakage of filter 22.

If the filter 22 and the protection members 23, 24 are integrally formed as a unit, assembly of filter 22 etc. will become easier. It is also noted that the shape of the pressure escape portion 21, the shape of the holes formed in the protection member 23, and the material thereof do not have to be limited to those in the previous embodiments.

[Fourth Embodiment]

Figure 10:
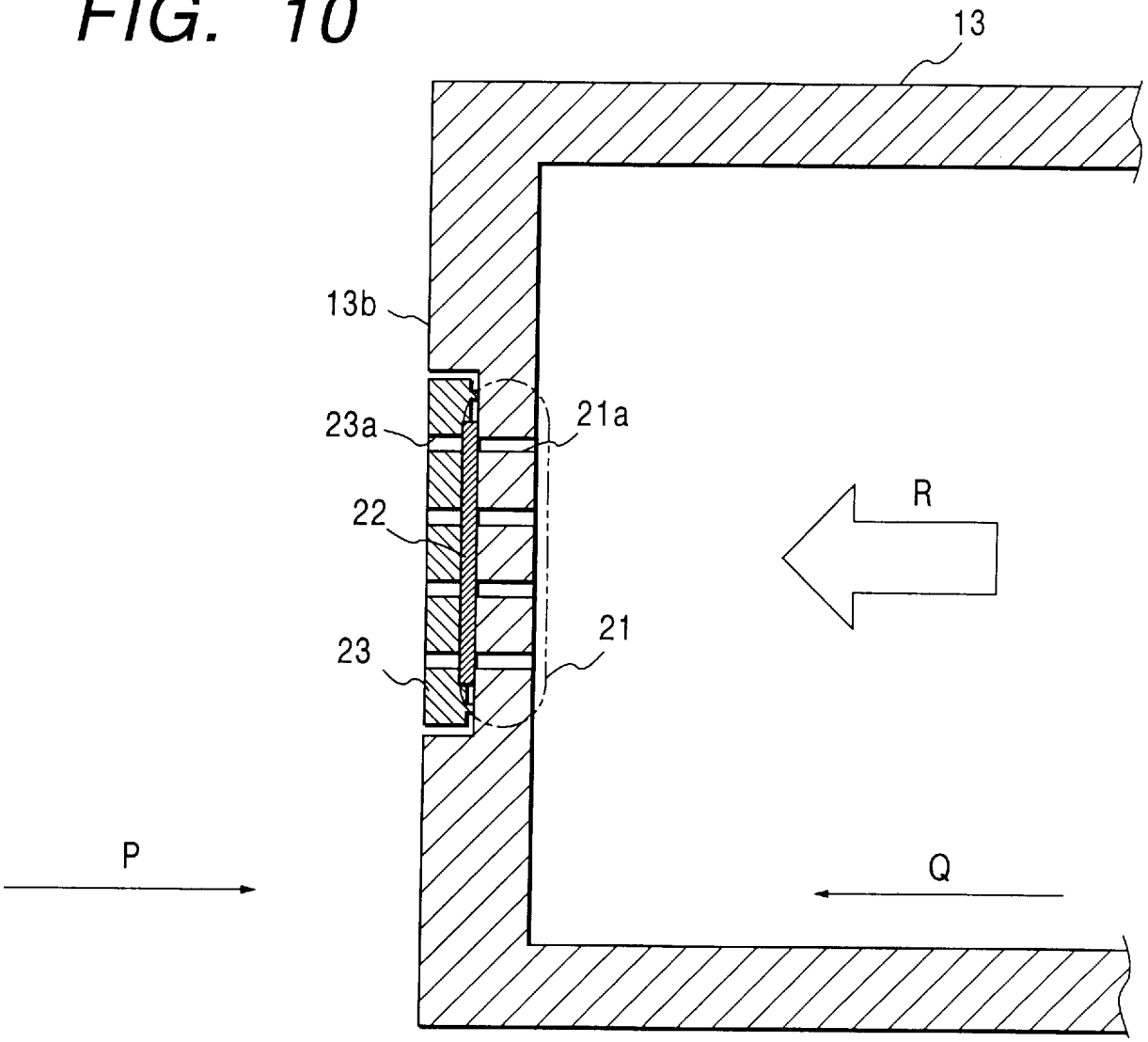
FIG. 10 is a cross-sectional, explanatory drawing of the filter attaching portion according to the fourth embodiment.
Figure 11:
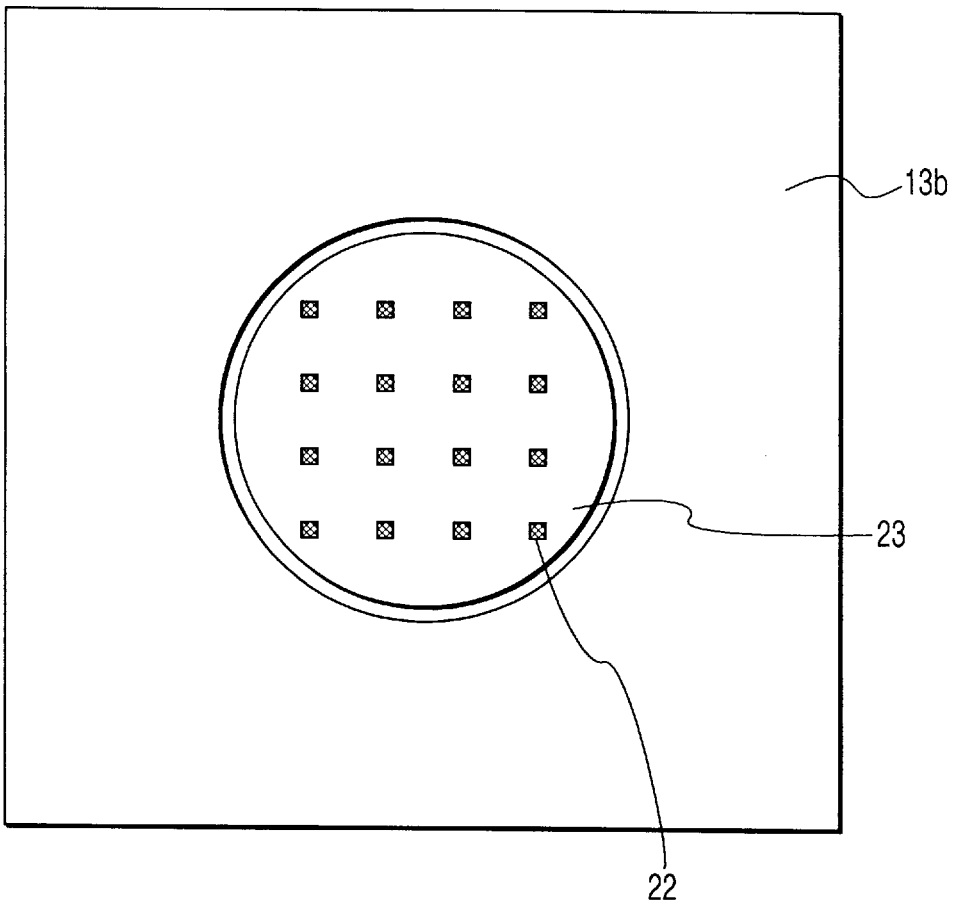
FIG. 11 is an explanatory drawing obtained by observing a protection member along the arrow P of FIG. 10.
Figure 12:
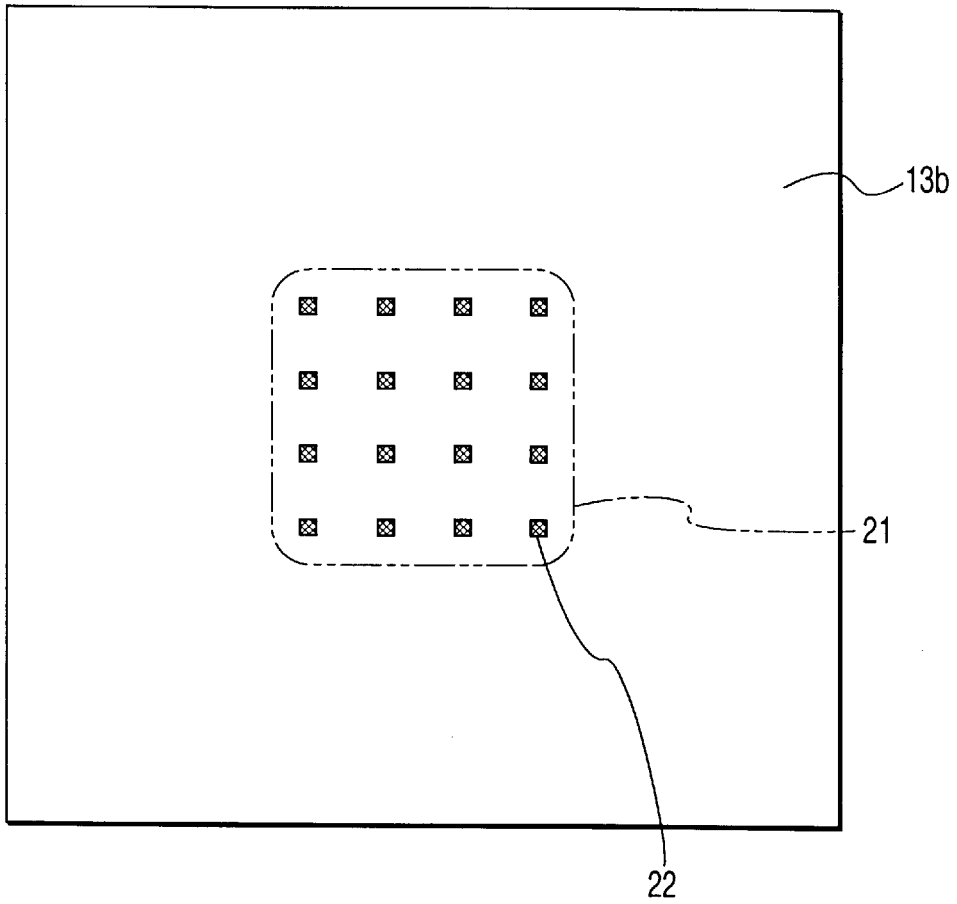
FIG. 12 is an explanatory drawing obtained by observing the protection portion along the arrow R of FIG. 10.

Another embodiment of the installation structure of the pressure relief portion and filter in the developing device will be described referring to FIG. 10 to FIG. 12. FIG. 10 is a cross-sectional, explanatory drawing of the filter attaching portion according to the fourth embodiment, FIG. 11 is an explanatory drawing to show a view of the protection member observed along the arrow P of FIG. 10, and FIG. 12 is an explanatory drawing to show a view of the protection portion observed along the arrow Q of FIG. 10. Also in this case, the elements functioning in the same way as in the previous embodiments will be denoted by the same reference characters and redundant description will be omitted.

The third embodiment described above showed the example in which the inside protection member 24 for protecting the filter 22 from the internal force was constructed separately from the toner container 13, whereas the present embodiment has the inside protection member integrally formed with the toner container 13.

Specifically, at least one small hole 21*a* is provided as the pressure relief portion 21 of toner container 13, a recess is formed in the outside of the wall surface in which the pressure relief portion 21 is formed, and the filter 22 and the outside protection member 23 having many holes 23*a* are fit into the recess. This pressure relief portion 21 has the same function as the inside protection member described above (the portion indicated by the chain double-dashed line in FIG. 10 and FIG. 12). In this arrangement, when the filter 22 is on the bottom side during carry of developing device D or the like so that the toner is concentrated in the direction of arrow R of FIG. 10, the all weight of toner is not exerted on the filter 22, because the container wall covers the filter 22. Therefore, the filter 22 is protected from the internal force, thus being free of damage or the like. In addition, the integral configuration of the inner protection member with the toner container 13 can decrease its cost and enhance, its assembly and its quality.

FIG. 11 and FIG. 12 illustrate the small holes as square holes, but these small holes may be formed as circular holes, elongate holes, or the like.

[Fifth Embodiment]

Figure 13:
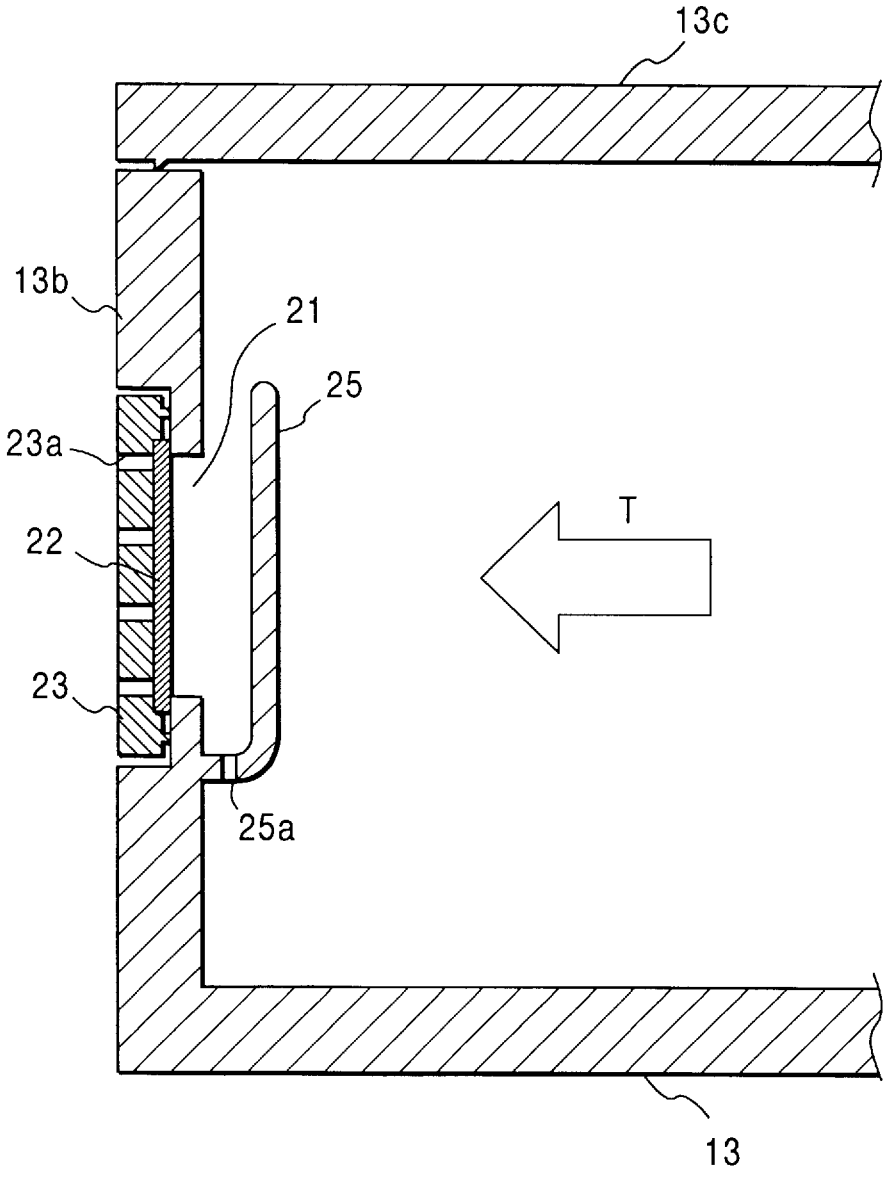
FIG. 13 is a cross-sectional, explanatory drawing of the filter attaching portion according to the fifth embodiment.

Another embodiment of the installation structure of the pressure relief portion and filter in the developing device will be described referring to FIG. 13. FIG. 13 is a cross-sectional, explanatory drawing of the filter attaching portion according to the fifth embodiment. Also in this case, the elements functioning in the same manner as in the previous embodiments will be denoted by the same reference characters and redundant description will be omitted.

In this embodiment, the filter 22 and outside protection member 23 in the first embodiment are integrally constructed and a canopy 25 as a protection wall is provided so as to cover the portion of the pressure relief portion 21 when seen from the inside of the toner container 13.

By this arrangement, the canopy 25 protects the inside of filter 22 in the container. Even if the toner flows in the direction of arrow T of FIG. 13 because of the gravity with the attaching surface side of filter 22 being on the bottom side during carry of developing device D or the like, the canopy 25 protects the filter 22 from direct impact of toner. Therefore, the filter 22 can be protected from the internal force.

A toner escape hole 25*a* for letting the toner escape therethrough is provided in the root portion of the canopy 25, so that the toner passing between the filter 22 and the canopy 25 can escape through the hole 25*a* to the inside of container, thus maintaining the permeability of filter 22. If the hole 25*a* is open toward the opening part of container where a lid member 13*c* of toner container 13 is attached by thermal bonding or the like, producibility of draft direction of mold, drilling, or the like will be improved.

The above arrangement can also prevent or reduce the external force upon manipulation of user or the like or the powder pressure upon physical distribution from being exerted directly on the filter 22, thus preventing damage or degradation of performance of the filter 22.

[Sixth Embodiment]

Figure 14:
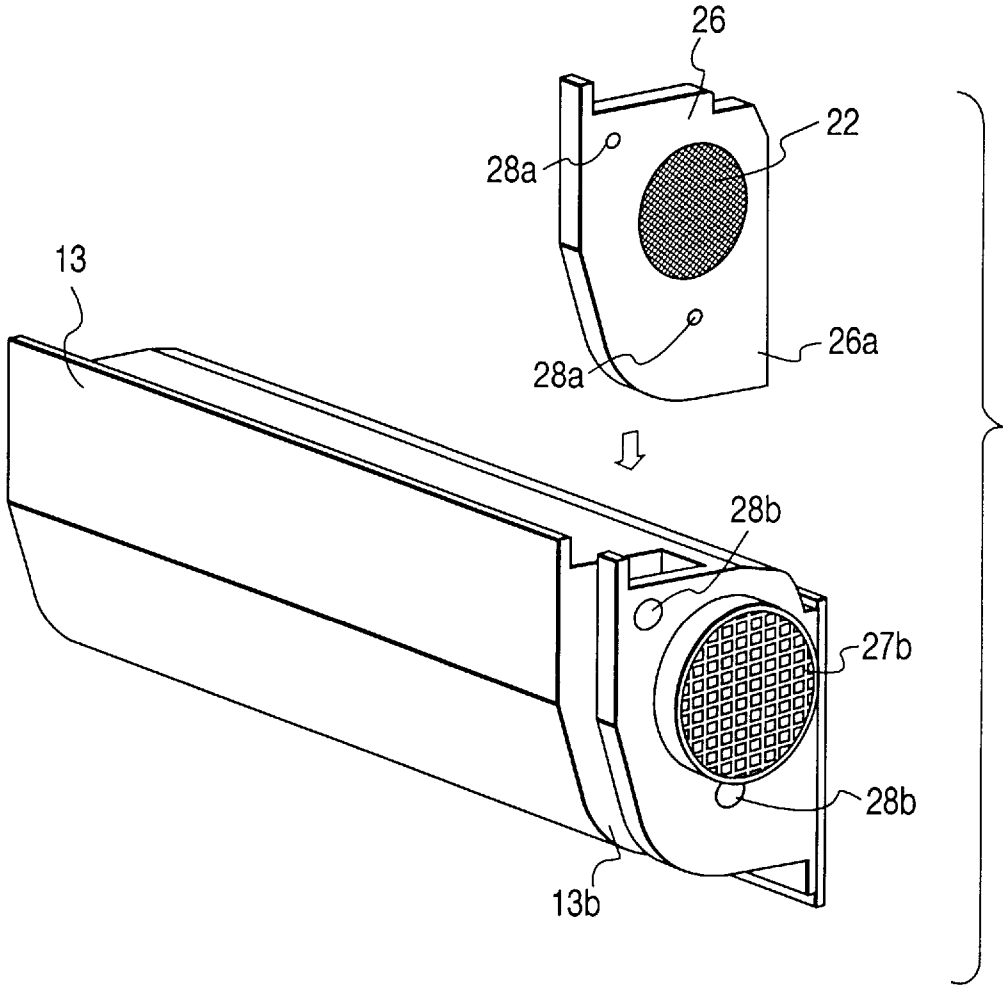
FIG. 14 is a perspective, explanatory drawing of the filter attaching portion according to the sixth embodiment.
Figure 15:
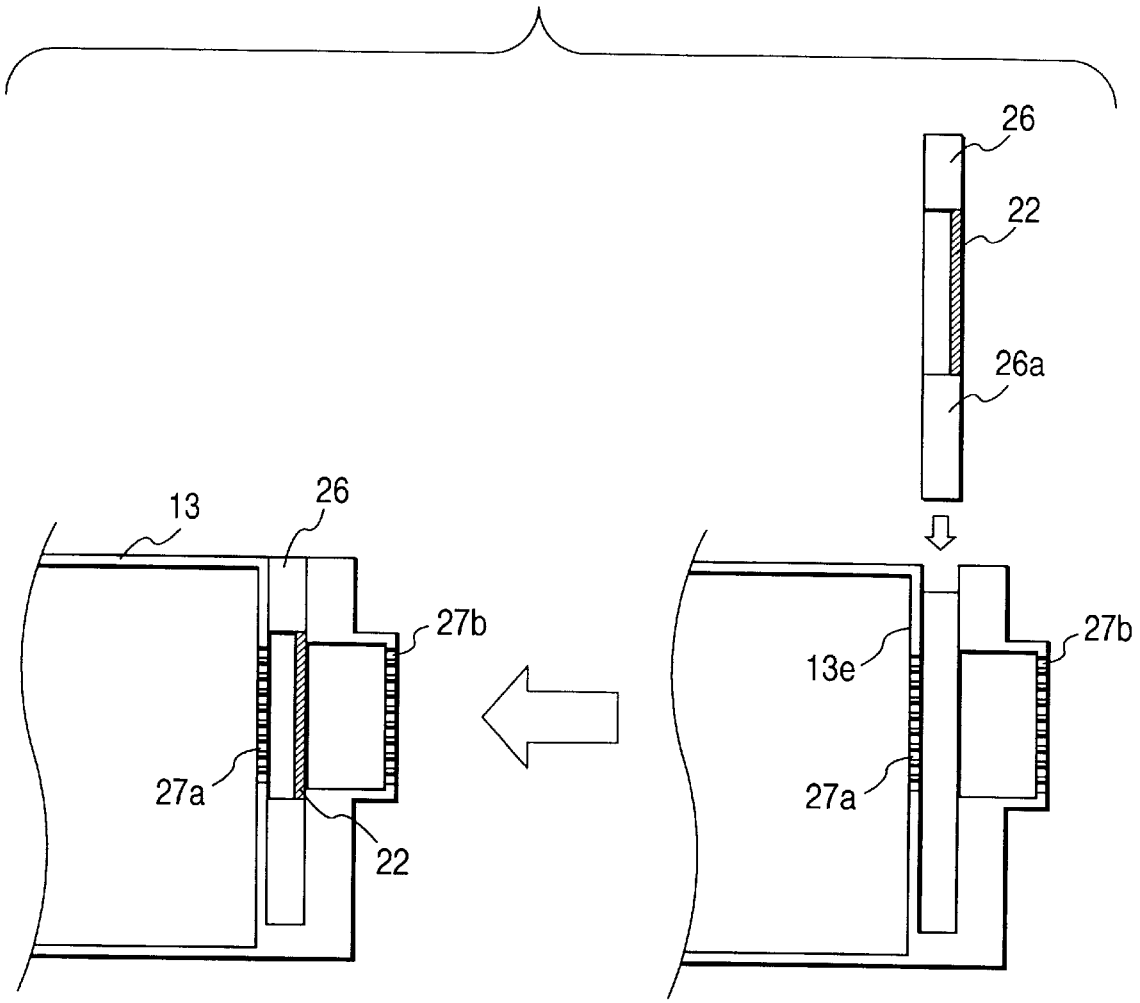
FIG. 15 is a cross-sectional, explanatory drawing of the filter attaching portion.

Another embodiment of the installation structure of the pressure escape portion and filter in the developing device will be described referring to FIG. 14 and FIG. 15. FIG. 14 is a perspective, explanatory drawing of the filter attaching portion according to the sixth embodiment and FIG. 15 is a cross-sectional, explanatory drawing of the filter attaching portion. Also in this case, the elements functioning in the same manner as in the previous embodiments will be denoted by the same reference characters and redundant description will be omitted.

In this embodiment a slot portion 13*d* for a filter unit 26 to be inserted therein is formed at one end in the longitudinal direction of the toner container 13. A filter inside protection member 27*a* having holes in the grid pattern is formed in an inside side wall portion 13*e* located inside in the longitudinal direction among the container side wall portions facing the slot portion 13*d*, and this filter inside protection member 27*a* is the pressure relief portion. Further, a filter outside protection member 27*b* having holes in the grid pattern is formed opposite the filter inside protection member 27*a*, and the filter unit 26 is inserted between the two protection members 27*a*, 27*b*.

The filter unit 26 is composed of the filter 22 and a screwing member 26*a* and is attached at a predetermined position of the slot portion 13*d* to the toner container 13 by screwing through screw holes 28*a*, 28*b*.

By the above arrangement, the filter inside protection member 27*a* protects the filter 22 from the internal force and the filter outside protection member 27*b* protects the filter from the external force. This prevents the filter 22 from being damaged by the powder pressure, the force during physical distribution, or the like.

[Seventh Embodiment]

Figure 16:
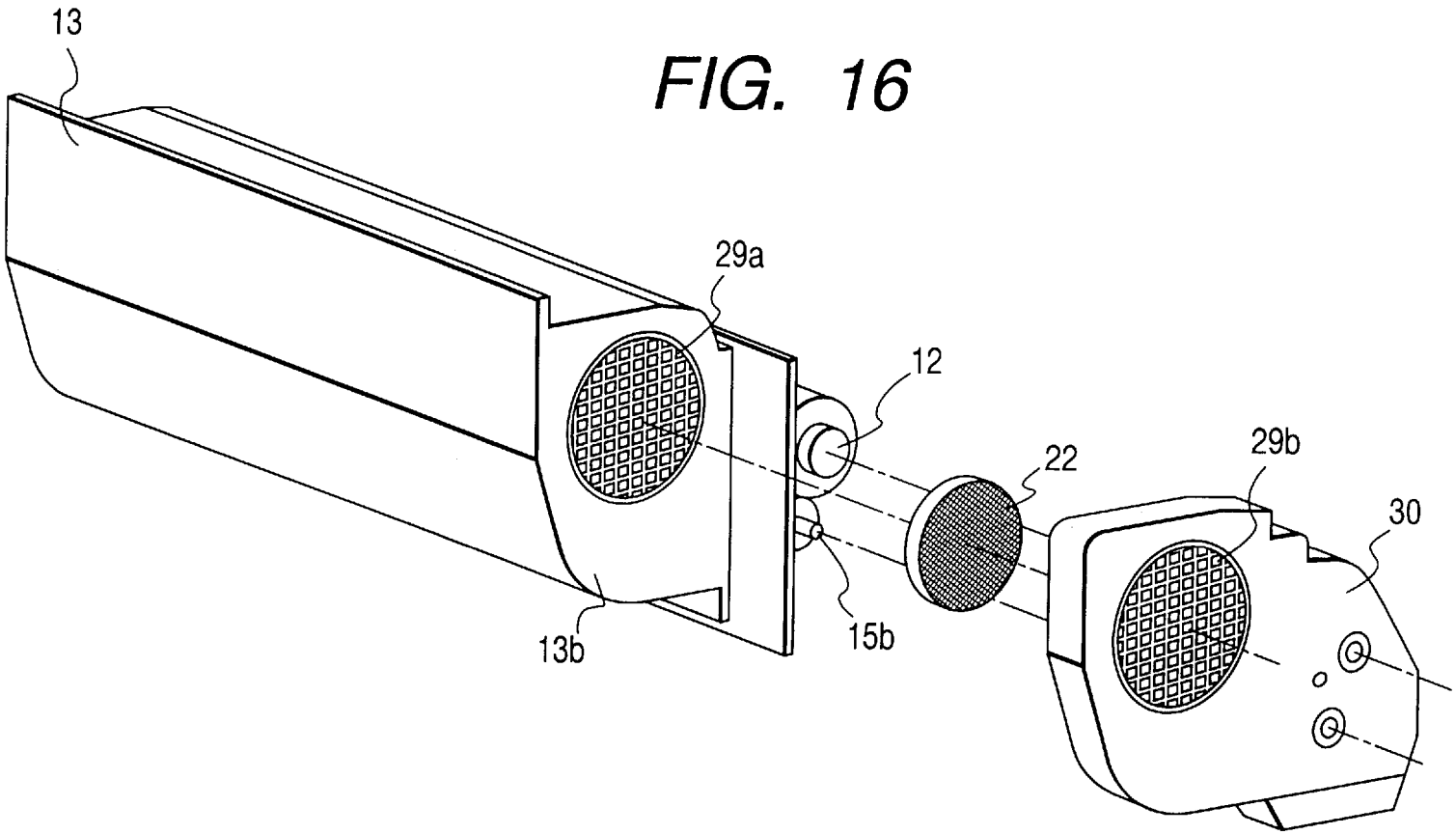
FIG. 16 is a perspective, explanatory drawing of the filter attaching portion according to the seventh embodiment.
Figure 17:
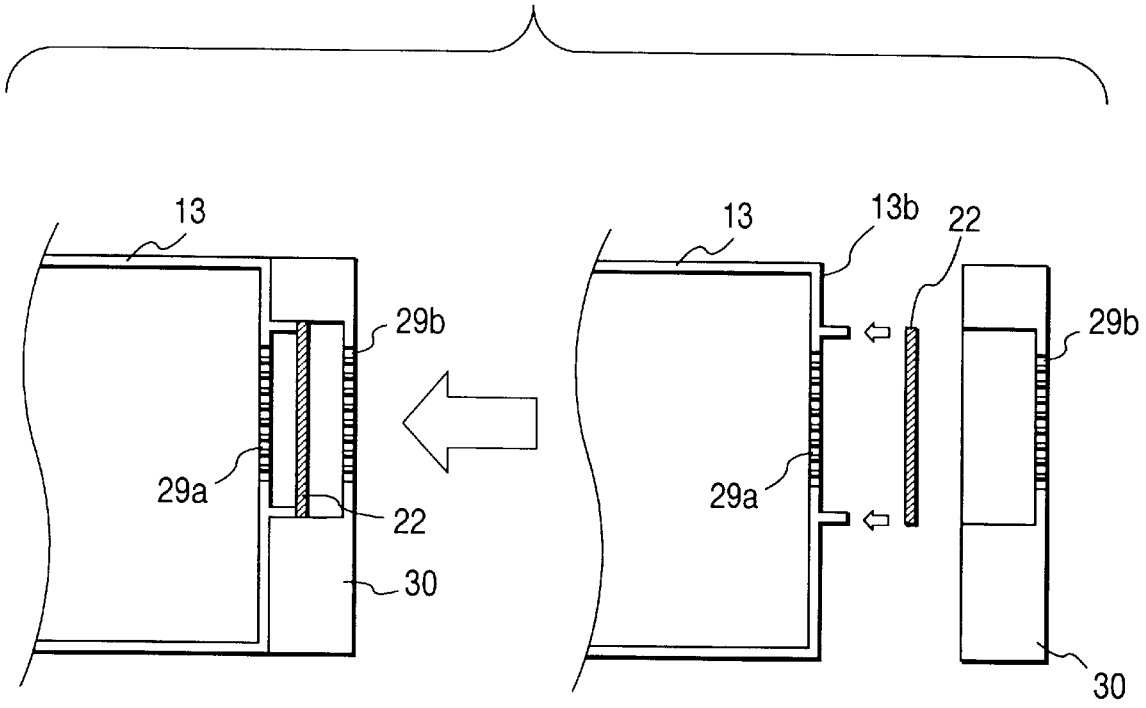
FIG. 17 is a cross-sectional, explanatory drawing of the filter attaching portion.
Figure 18:
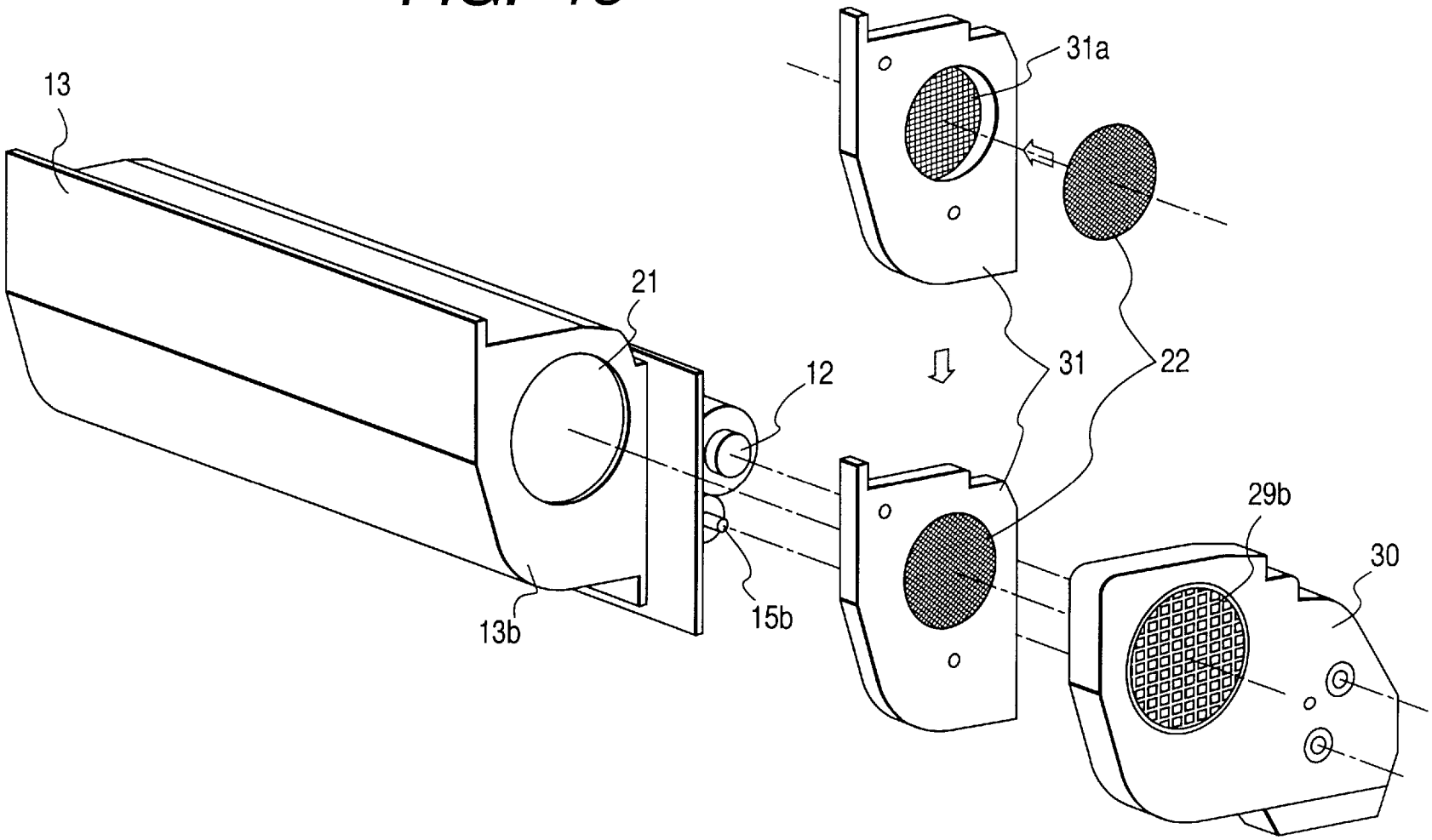
FIG. 18 is a perspective, explanatory drawing of the filter attaching portion in the unit form of filter.
Figure 19:
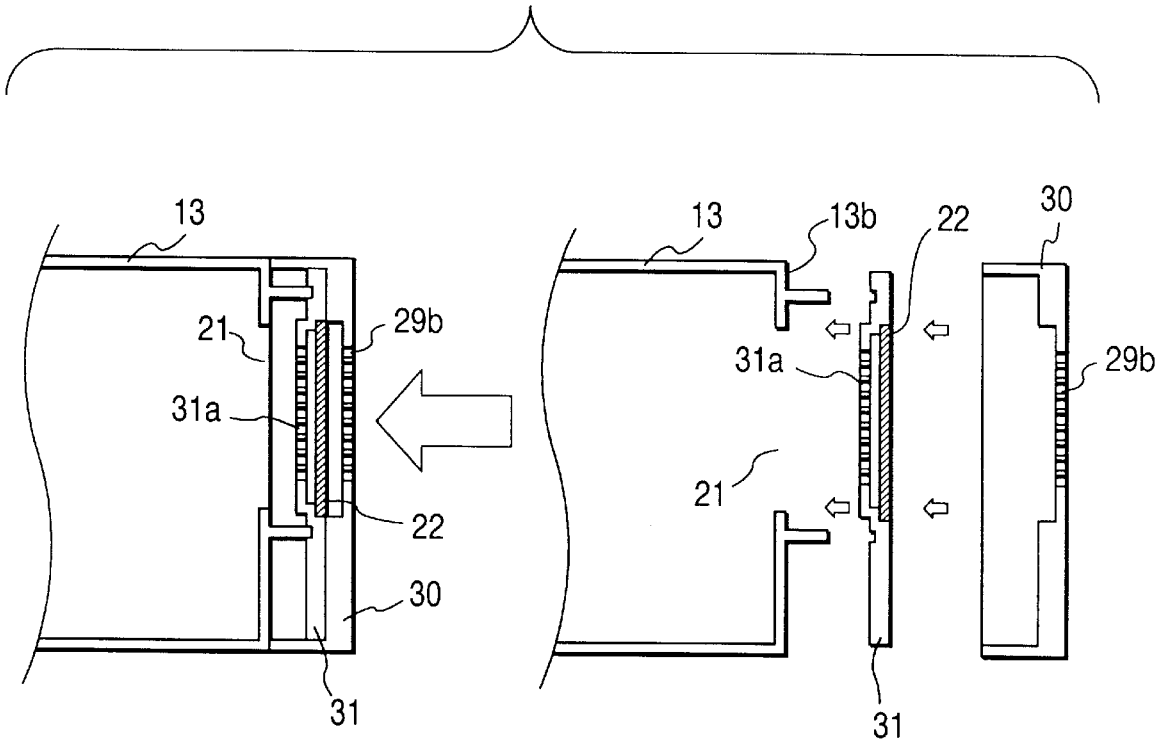
FIG. 19 is a cross-sectional, explanatory drawing of the filter attaching portion.

Another embodiment of the installation structure of the pressure relief portion and filter in the developing device will be described referring to FIG. 16 to FIG. 19. FIG. 16 is a perspective, explanatory drawing to illustrate the filter attaching portion according to the seventh embodiment and FIG. 17 is a cross-sectional, explanatory drawing of the filter attaching portion. FIG. 18 is a perspective, explanatory drawing to illustrate the filter attaching portion where the filter is formed as a unit and FIG. 19 is a cross-sectional, explanatory drawing of the filter attaching portion. Also in this case, the elements functioning in the same manner as in the previous embodiments will be denoted by the same reference characters and redundant description will be omitted.

As shown in FIG. 16 and FIG. 17, a filter inside protection member 29*a* having holes in the grid pattern to become the pressure relief portion is formed in the wall surface 13*b* at one end in the longitudinal direction of the toner container 13. Further, a filter outside protection member 29*b* having holes in the grid pattern is formed in a holder 30 having a function to position and hold the developing roller 12 and toner supply roll 15*b* at the predetermined positions. This holder 30 is attached and fixed to the wall surface 13*b* and it is fixed by a method of adhesion, welding, or the like with the filter 22 being sandwiched between the inside and outside protection members 29*a*, 29*b*.

As shown in FIG. 18 and FIG. 19, the installation structure may be modified in such a way that the pressure relief portion 21 of the hole shape is formed in the wall surface 13*b* of the toner container 13 and that the aforementioned holder 30 is attached and fixed to this wall surface 13*b*. In this case, the filter 22 is constructed as a filter unit 31 and the filter inside protection member 31*a* is formed further inside to be closer to the container than the filter 22 is. Then the unit is fixed so that the filter 22 is sandwiched between the filter inside protection member 31*a* and the filter outside protection member 29*b*.

The filter outside protection member 29*b* of the grid pattern is formed in the holder 30 so as to prevent the inside of holder 30 from being closed hermetically, but any arrangement may be employed without having to be limited to the above grid-pattern structure as long as the inside of holder can be prevented from being closed hermetically.

The arrangement of the present embodiment can also prevent the internal force and external force toward the filter 22 from being exerted directly on the filter 22, thus achieving the same effect as in the previous embodiments.

[Eighth Embodiment]

Figure 20:
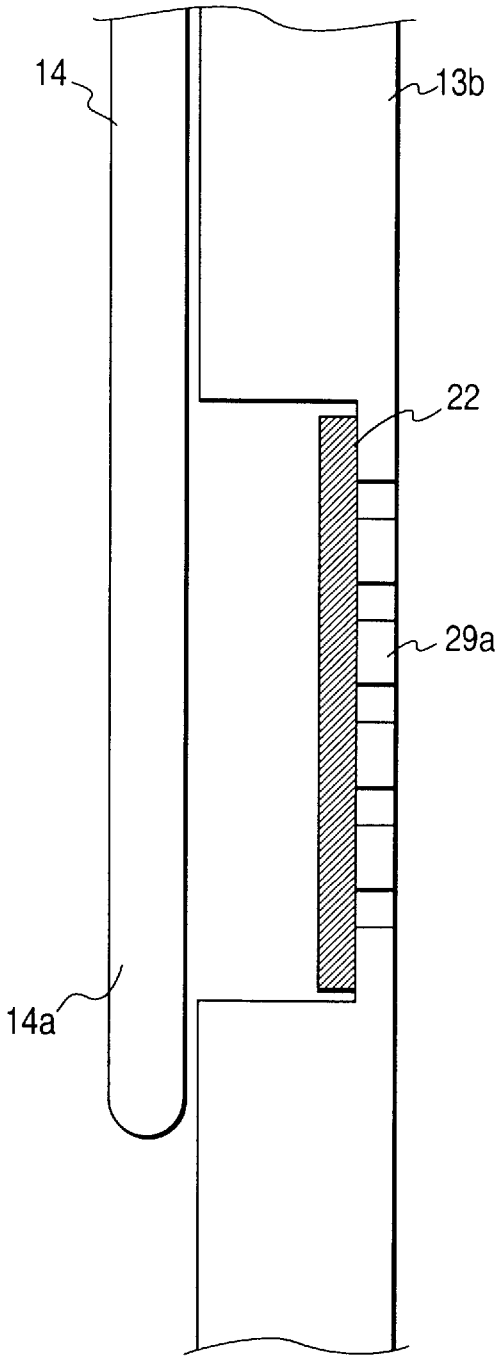
FIG. 20 is a cross-sectional, explanatory drawing of the filter attaching portion according to the eighth embodiment.
Figure 21A:
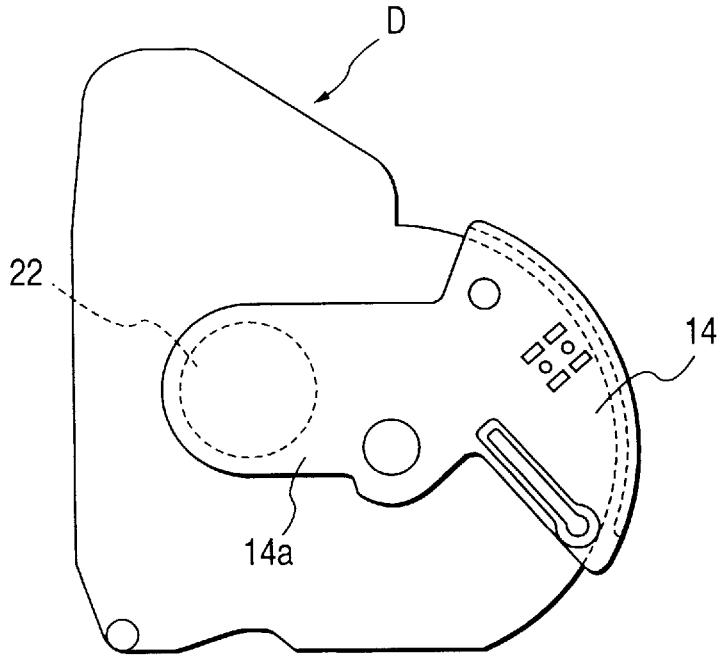
FIGS. 21A and 21B are explanatory drawings to explain the relation between the filter attaching portion and a shutter.
Figure 21B:
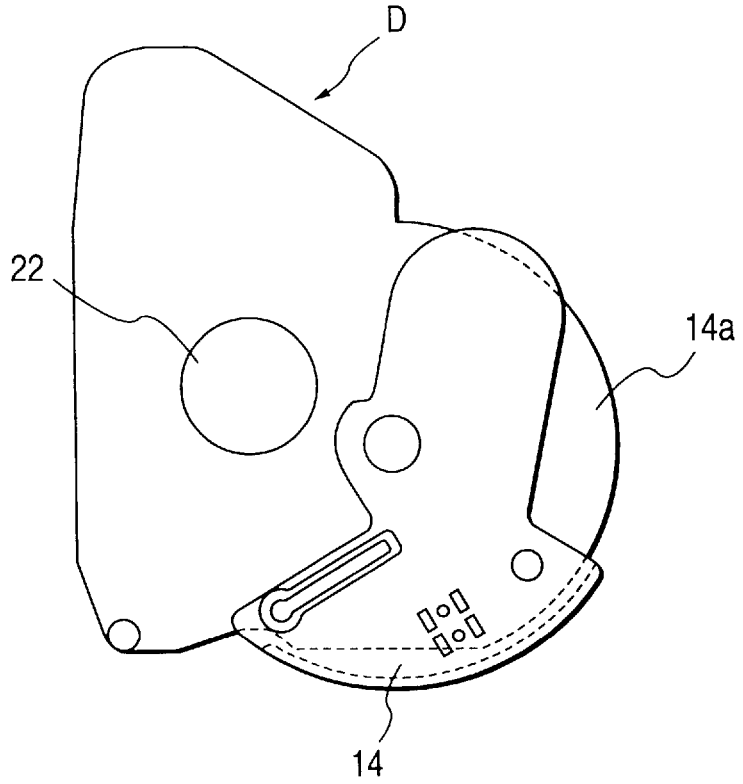

Another embodiment of the installation structure of the pressure relief portion and filter in the developing device will be described referring to FIG. 20 and FIGS. 21A and 21B. FIG. 20 is a cross-sectional, explanatory drawing of the filter attaching portion according to the eighth embodiment and FIGS. 21A and 21B are explanatory drawings to illustrate the relationship between the filter attaching portion and a shutter. Also in this case, the elements functioning in the same way as in the previous embodiments will be denoted by the same reference characters and redundant description will be omitted.

In this embodiment a filter outside protection member 14*a* for protecting the filter 22 from the external force which could be exerted on the filter 22 during physical distribution or when the user directly touches the filter 22, is constructed integrally with shutter 14, whereby the filter 22 is protected by the filter outside protection member 14*a* all the time except for the duration that the developing device D is mounted on the image forming apparatus.

The filter outside protection member 14*a* is interlocked with opening/closing of shutter 14 and the filter outside protection member 14*a* covers the filter 22 while the shutter 14 is closed, as shown in FIG. 21A. When the developing device D is mounted on the main body of image forming apparatus, the shutter 14 rotates to free the portion of filter 22 from the filter outside protection member 14*a,* as shown in FIG. 21B. This permits the filter outside protection member 14*a* to protect the filter 22 from the external force which could be applied thereto while the developing device D is not mounted on the main body of image forming apparatus.

[Ninth Embodiment]

Figure 22A:
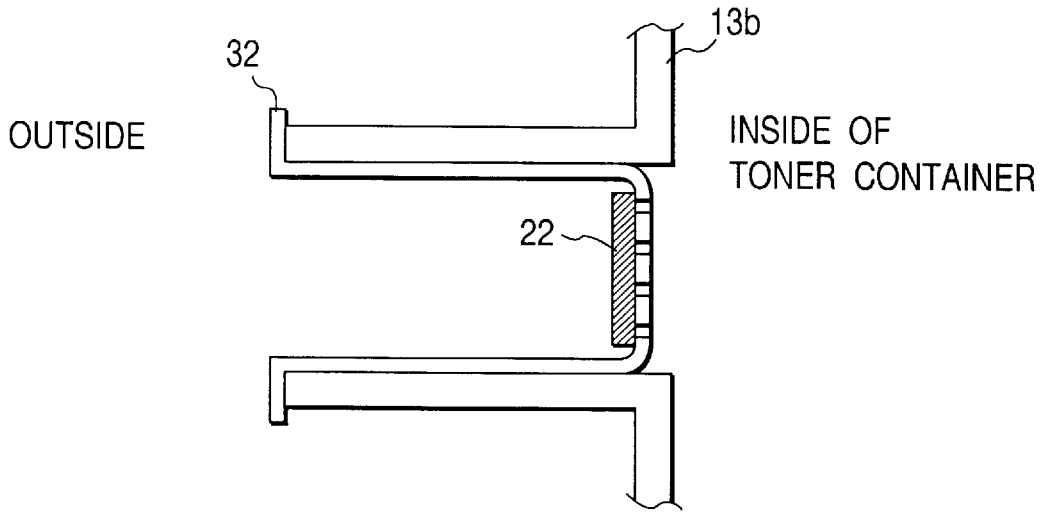
FIGS. 22A and 22B are cross-sectional, explanatory drawings to explain the attachment of a toner cap according to the ninth embodiment.
Figure 22B:
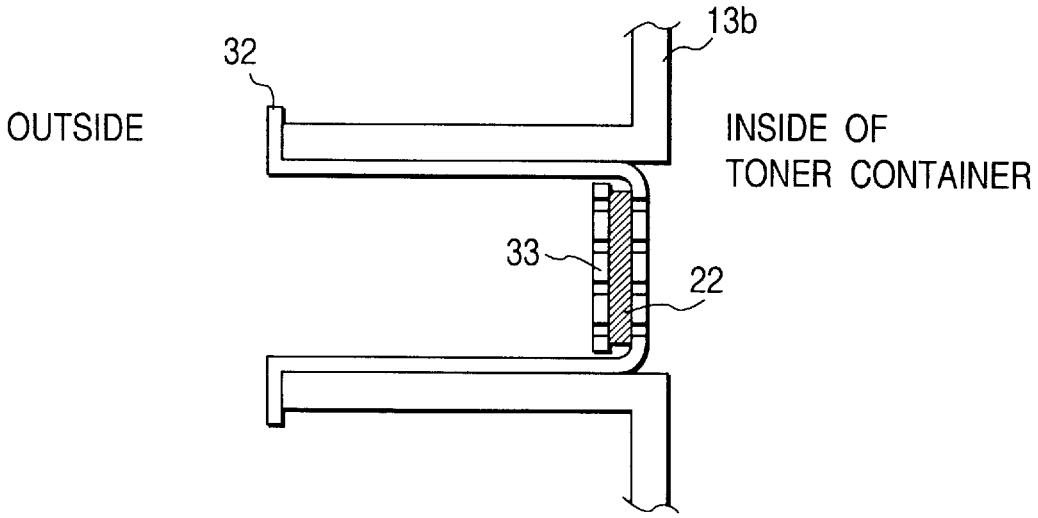
Figure 23A:
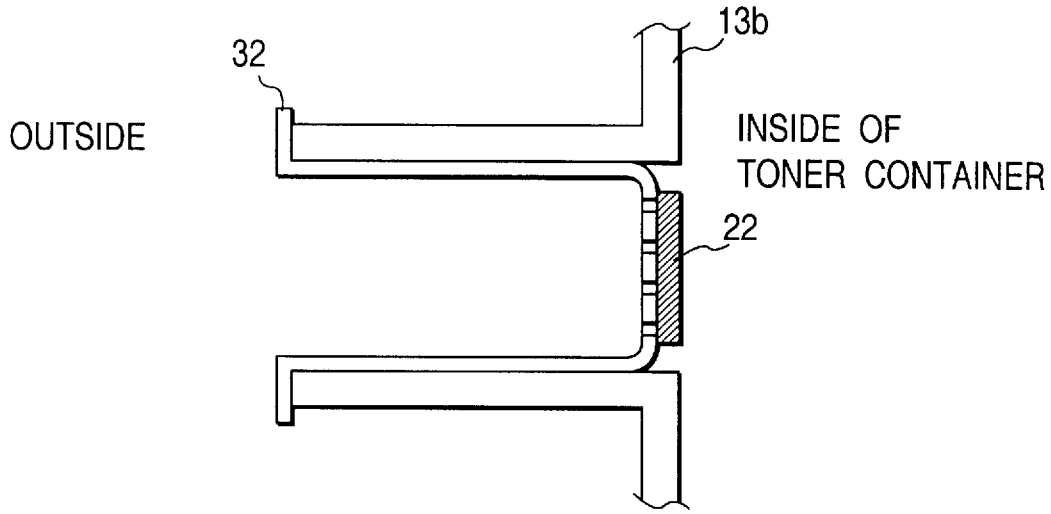
FIGS. 23A and 23B are cross-sectional, explanatory drawings to explain the attachment of a toner cap for protecting the both surfaces of filter.
Figure 23B:
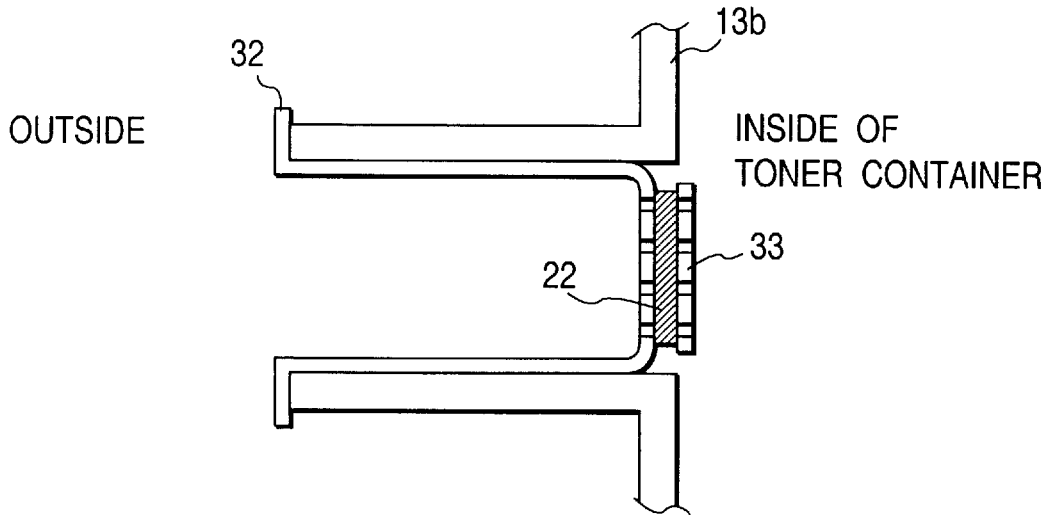
Figure 24:
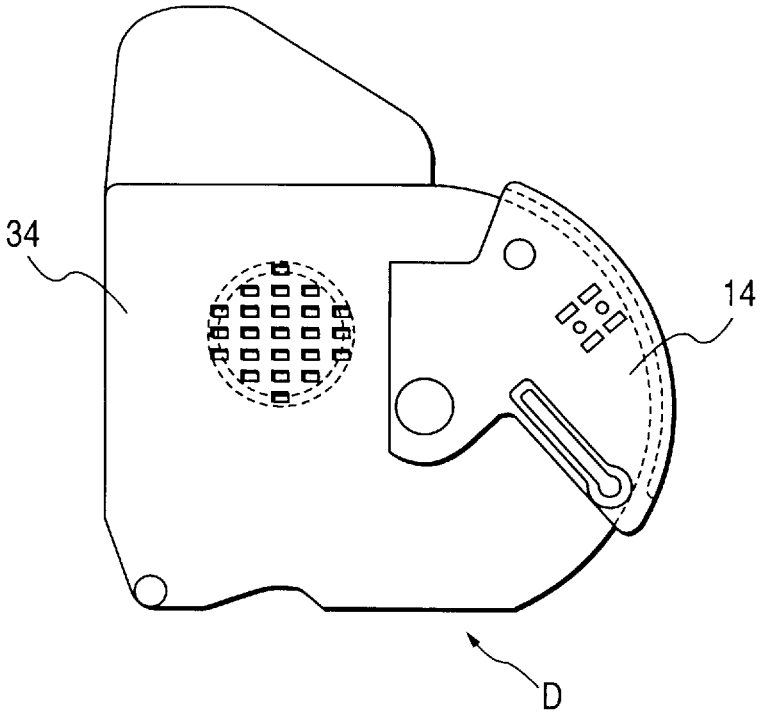
FIG. 24 is an explanatory drawing to explain the relation with the shutter.

Another embodiment of the installation structure of the pressure relief portion and filter in the developing device will be described referring to FIGS. 22A and 22B to FIG. 24. FIGS. 22A and 22B are cross-sectional, explanatory drawings of installation of a toner cap according to the ninth embodiment, FIGS. 23A and 23B are cross-sectional, explanatory drawings of installation of a toner cap for protecting the both surfaces of filter, and FIG. 24 is an explanatory drawing to illustrate the relation with the holder. Also in this case, the elements functioning in the same way as in the previous embodiments will be denoted by the same reference characters and redundant description will be omitted.

In this embodiment a toner charge port for charging the toner into the toner container 13 is used as the pressure relief portion 21, a toner cap 32, attached as pressed into this pressure relief portion 21, is provided with holes in the grid pattern, and the filter is attached thereto.

The filter 22 may be attached to the outside surface of toner cap 32 outside the container as shown in FIG. 22A or to the inside surface of toner cap 32 inside the container as shown in FIG. 23A. Further, if a filter protection member 33 is attached to the film surface opposite the surface of toner cap 32 as shown in FIG. 22B and FIG. 23B, the both side surfaces of filter 22 can be protected.

In place of the filter protection member 33, the developing device may use a holder 34 having an opening portion for preventing the pressure in the toner container from being shut completely and having a function to position and hold the developing roller at the predetermined position, as shown in FIG. 24.

By making the toner charge port function as the pressure relief portion and by making the toner cap 32 and filter 22 for covering it function as the protection member as described above, the same effect as in the previous embodiments can be achieved, the structure can be simplified, and the number of components can be decreased.

[Tenth Embodiment]

Figure 25:
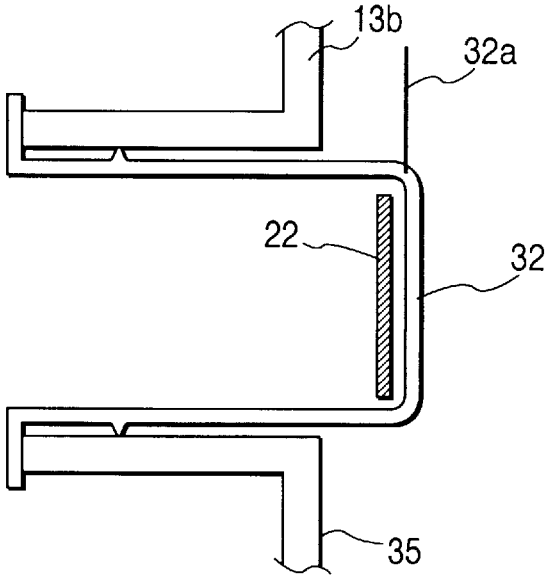
FIG. 25 is a cross-sectional, explanatory drawing to explain the attachment of the toner cap according to the tenth embodiment.

Another embodiment of the installation structure of the pressure relief portion and filter in the developing device will be described referring to FIG. 25. FIG. 25 is a cross-sectional, explanatory drawing of installation of a toner cap according to the tenth embodiment. Also in this case, the elements functioning in the same way as in the previous embodiments will be denoted by the same reference characters and redundant description will be omitted.

In this embodiment, the surface with many holes of the toner cap 32 in the ninth embodiment described above is arranged to be located more inside of toner container than the toner charge port is (i.e., the surface is located at a position projecting more into the inside of toner container than the internal wall 35 of container is).

This arrangement eliminates the toner stay area between the filter attaching surface 32*a* and the container internal wall 35, thereby effectively preventing degradation of performance of filter 22.

[Eleventh Embodiment]

Figure 26:
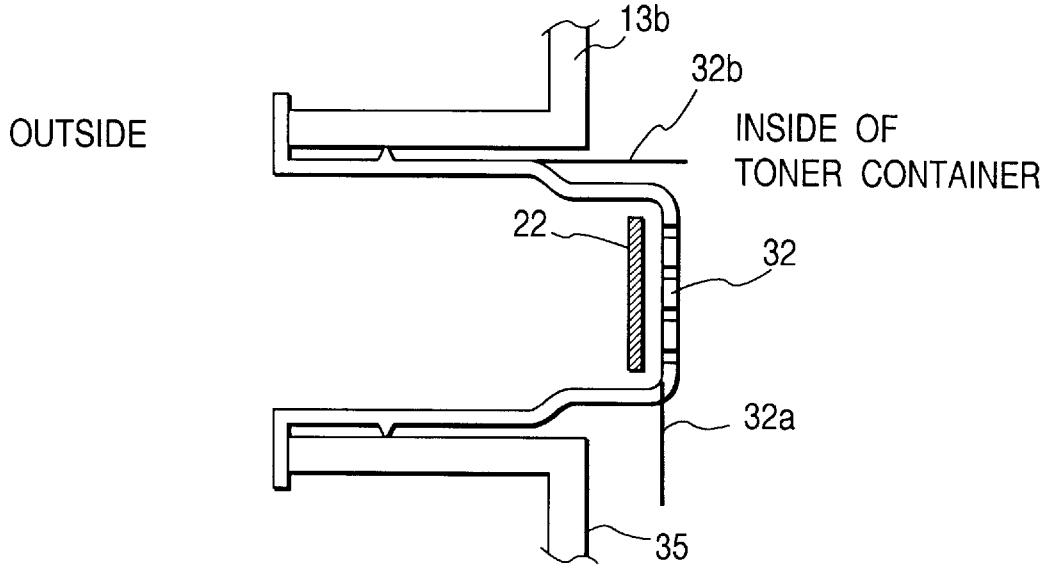
FIG. 26 is a cross-sectional, explanatory drawing to explain the attachment of the toner cap according to the eleventh embodiment.

Another embodiment of the installation structure of the pressure relief portion and filter in the developing device will be described referring to FIG. 26. FIG. 26 is a cross-sectional, explanatory drawing of installation of the toner cap according to the eleventh embodiment. Also in this case, the elements functioning in the same manner as in the previous embodiments will be denoted by the same reference characters and redundant description will be omitted.

In this embodiment, the filter-attached surface of the toner cap 32 in the ninth embodiment described above is formed smaller than fitting part 32*b* (fitting/deforming region) and the filter 22 is arranged to be attached outside the deforming region when the toner cap 32 is fit in the toner charge port.

This arrangement can effectively prevent deformation or damage of filter 22 upon press fitting of toner cap 32.

[Twelfth Embodiment]

Figure 27:
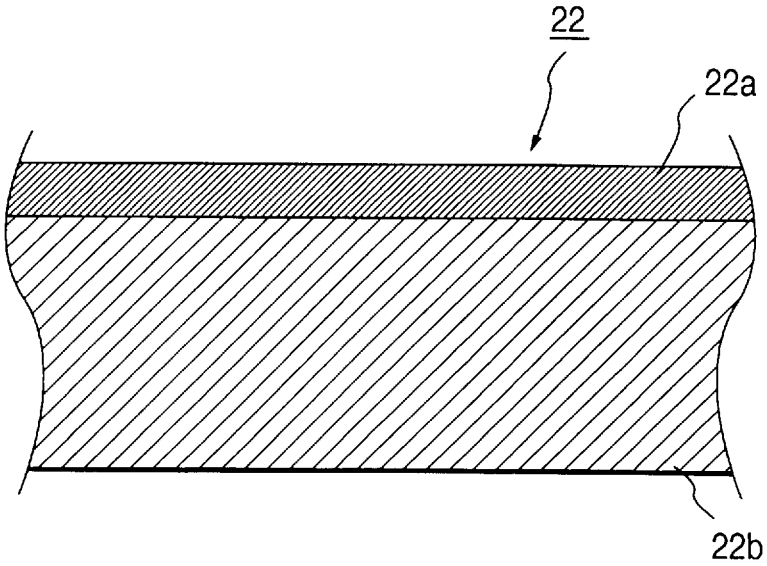
FIG. 27 is a cross-sectional, explanatory drawing of filter.

Next described is a preferred arrangement of filter 22 as another embodiment, used in the foregoing embodiments. FIG. 27 is a cross-sectional, explanatory drawing of the filter.

A first layer 22*a* of this filter 22 is a porous film of tetrafluoroethylene resin the surface of which is subjected to the oil-repellent treatment and pore sizes of which are between 1 and 5 $\mu$m. A second layer 22*b* is a base member of the filter, which is of a woven fabric or a non-woven fabric of polyester, polypropylene, or polyethylene terephthalate based resin. These first layer 22*a* and second layer 22*b* are laminated to form the filter 22.

The above two-layer structure of filter 22 can facilitate installation to the toner container 13 by thermal bonding, adhesion, or the like and can decrease clogging.

The embodiments of the present invention were described above, but it should be noted that the present invention is by no means limited to these embodiments and that the invention may involve all modifications falling within the scope of technological idea thereof.

What is claimed is:

1. A developing device capable of being detachably mounted to an image forming apparatus, said developing device comprising:

a developer carrying member for forming a development region together with an image carrying member, said developer carrying member rotating while carrying a developer;

a developer containing section for containing the developer to be supplied to said developer carrying member;

a pressure relief portion provided in a surface of the developer containing section; and a protection wall for reducing pressure applied by the developer on said pressure relief portion.

2. The developing device according to claim 1, wherein the pressure relief portion has a filter.

3. The developing device according to claim 2, comprising a protection member for protecting the filter.

4. The developing device according to claim 1, wherein the pressure relief portion comprises a plurality of fine holes provided in a container forming the developer containing section.

5. The developing device according to claim 1, wherein said image forming apparatus comprises a rotary unit which said developing device is mountable, and said pressure relief portion is provided in a surface substantially perpendicular to the rotational axis of said rotary unit.

6. The developing device according to claim 5, wherein said protection wall has a hole for letting the developer pass.

7. The developing device according to claim 1, wherein the pressure relief portion is formed by mounting a filter member to a charge port for charging the developer into the developer containing section.

8. The developing device according to claim 7, wherein the filter member has a cap member press-fitted into the charge port and having a plurality of holes, and a filter attached to said cap member.

9. The developing device according to claim 8, wherein said filter is attached outside a region where said cap member is deformed when press-fitted into the charge port.

10. A developing device capable of being detachably mounted to an image forming apparatus, said developing device comprising:

a developer carrying member for forming a development region together with an image carrying member, said developer carrying member rotating as carrying a developer;

a developer containing section for containing the developer to be supplied to said developer carrying member;

a filter for relieving a pressure in the developer containing section, said filter having a porous film of tetrafluoroethylene resin, a surface of which is subjected to the oil-repellent treatment.

11. The developing device according to claim 10, wherein a mean pore size of the porous film of tetrafluoroethylene resin is between 1 and 5 $\mu$m.

12. The developing device according to claim 10, wherein said filter is a laminate of the porous film of tetrafluoroethylene resin on a fabric.

13. The developing device according to claim 12, wherein the fabric is a woven fabric or a non-woven fabric made of polyester, polypropylene, or polyethylene terephthalate based resin.

14. The developing device according to claim 10, wherein said image forming apparatus comprises a rotary unit on which said developing device is mountable, and said pressure relief portion is provided in a surface substantially perpendicular to the rotational axis of said rotary unit.

* * * * *

UNITED STATES PATENT AND TRADEMARK OFFICE

CERTIFICATE OF CORRECTION

PATENT NO. : 5,887,227

DATED : March 23, 1999

INVENTOR(S) : TACHIO KAWAI, ET AL.

It is certified that error appears in the above-identified patent and that said Letters Patent is hereby corrected as shown below:

COLUMN 3,
Line 64, "Driving" should read --A driving--.

COLUMN 6,
Line 40, "start" should read --to start--; and
Line 62, "ate" should read --are--.

COLUMN 9,
Line 11, "assembly" should read --assemblability--.

COLUMN 13,
Line 12, "which" should read --on which--.

COLUMN 14,
Line 7, "member;" should read --member; and--.

Signed and Sealed this

Thirty-first Day of August, 1999

*Attest:*

Q. TODD DICKINSON

*Attesting Officer*

*Acting Commissioner of Patents and Trademarks*